US008339423B2

(12) United States Patent
Tomizawa et al.

(10) Patent No.: US 8,339,423 B2
(45) Date of Patent: Dec. 25, 2012

(54) DISPLAY APPARATUS, DISPLAY METHOD, DISPLAY MONITOR, AND TELEVISION RECEIVER

(75) Inventors: Kazunari Tomizawa, Kizugawa (JP); Yoshihiro Okada, Minamiashigara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1343 days.

(21) Appl. No.: 11/990,839

(22) PCT Filed: Aug. 18, 2006

(86) PCT No.: PCT/JP2006/316227
§ 371 (c)(1),
(2), (4) Date: Feb. 22, 2008

(87) PCT Pub. No.: WO2007/026551
PCT Pub. Date: Mar. 8, 2007

(65) Prior Publication Data

US 2009/0040242 A1 Feb. 12, 2009

(30) Foreign Application Priority Data

Aug. 29, 2005 (JP) ..... 2005-248245

(51) Int. Cl.
*G09G 5/10* (2006.01)

(52) U.S. Cl. ..... 345/690; 345/89

(58) Field of Classification Search ..... 345/87, 345/96, 690; 349/123; 348/458, 792
See application file for complete search history.

(56) References Cited

U.S. PATENT DOCUMENTS

| | | | | |
|---|---|---|---|---|
| 6,940,481 | B2 * | 9/2005 | Konno et al. | 345/96 |
| 8,026,934 | B2 * | 9/2011 | Tomizawa et al. | 345/690 |
| 2002/0158857 | A1 * | 10/2002 | Iisaka | 345/204 |
| 2003/0142050 | A1 | 7/2003 | Kim | |
| 2004/0057001 | A1 * | 3/2004 | Kim | 349/123 |
| 2004/0155847 | A1 * | 8/2004 | Taoka et al. | 345/87 |
| 2004/0196274 | A1 * | 10/2004 | Song et al. | 345/204 |
| 2005/0162360 | A1 | 7/2005 | Ishihara et al. | |
| 2005/0253785 | A1 * | 11/2005 | Miyasaka et al. | 345/63 |

FOREIGN PATENT DOCUMENTS

| | | |
|---|---|---|
| JP | 06-250609 | 9/1994 |
| JP | 09-212137 | 8/1997 |
| JP | 09-243998 | 9/1997 |
| JP | 11-095729 | 4/1999 |
| JP | 2002-062855 | 2/2002 |
| JP | 2004-240317 | 8/2004 |
| JP | 2005-173387 | 6/2005 |
| JP | 2005-173573 | 6/2005 |

* cited by examiner

*Primary Examiner* — Quan-Zhen Wang
*Assistant Examiner* — Calvin C Ma
(74) *Attorney, Agent, or Firm* — Harness, Dickey & Pierce, P.L.C.

(57) ABSTRACT

An image display period of a first sub frame of an N-th frame is arranged to partly overlap the image display period of the second sub frame of the N-th frame and the image display period of a second sub frame of the (N−1)-th frame. Grayscale display voltages with which pixels that are horizontally or vertically neighbored are charged are arranged to have inverse polarities, and the polarity of the grayscale display voltage charging each pixel is reversed in each frame. Furthermore, neighboring data signal lines are short-circuited each time the polarity of the grayscale display voltage output to each data signal line is reversed.

22 Claims, 15 Drawing Sheets

DISPLAY APPARATUS, DISPLAY METHOD, DISPLAY MONITOR, AND TELEVISION RECEIVER

TECHNICAL FIELD

The present invention relates to a liquid crystal display apparatus which displays an image corresponding to one frame by time-dividing a frame for one image into plural sub frames and displaying the image corresponding to the sub frames in one frame period.

BACKGROUND ART

In various technical fields, CRTs (Cathode Ray Tubes) have gradually been replaced by hold-type display apparatuses including a liquid crystal display module or an EL display module.

It is considered, however, that hold-type display apparatuses are inferior in moving image qualities to impulse-type display apparatuses such as CRTs (Cathode Ray Tubes) in which a turn-on time during which an image is displayed and a turn-off time during which an image is not displayed are alternated.

That is to say, in a typical hold-type display apparatus, a whole one frame period is an image turn-on time. On this account, once a frame image is updated, an object is being displayed until the image is updated in the next frame, and the image displayed in this way appears as motion blur for the viewer.

To achieve improvement in the moving image quality as one of the objectives, various methods have been proposed to perform driving in such a way as to time-divide a single frame for displaying one image into plural sub frames. An example of such methods is disclosed by Patent Document 1. It is noted that image display apparatuses adopting organic LED panels have been arranged so that vertical scanning is multiplexed.

Among hold-type display apparatuses, liquid crystal display apparatuses are disadvantageous in that the electro-optical properties of the liquid crystal are deteriorated when a unidirectional electric field is applied thereto over a long period of time. The liquid crystal display apparatuses are typically driven on AC in order to prevent the deterioration of the liquid crystal. In other words, the driving is typically performed such that the polarity of the voltage applied to each pixel is alternated.

Examples of the AC driving methods for applying a voltage to each pixel are as follows.

The polarity of voltages applied to respective pixels neighbored in the horizontal direction (the direction along the scanning signal lines) are differentiated, and the voltages applied to the pixels are reversed in each frame (line inversion driving).

The polarities of the voltages applied to the respective pixels neighbored in the vertical direction (the direction along the data signal lines) are differentiated (i.e. the polarity of the voltage applied to the pixels on a scanning signal line is reversed each time a different scanning signal line is scanned), and the voltage applied to each pixel is inverted.

The polarity of the voltage applied to a pixel is differentiated from the polarity of the voltages applied to the pixels which neighbor that pixel in the horizontal and vertical directions, and the voltage applied to each pixel is inverted in each frame (dot inversion driving).

FIG. 15(*a*) illustrates the polarity of the grayscale display voltage applied to each pixel in a conventional liquid crystal display apparatus performing the dot inversion driving. FIG. 15(*b*) is a timing chart showing the relationship between the grayscale display voltages applied to the respective pixels and time.

As shown in FIG. 15(*a*), in case of the dot inversion driving, the polarities of the grayscale display voltages applied to the horizontally-neighbored pixels are different, and the polarities of the grayscale display voltages applied to the vertically-neighbored pixels are also different. Furthermore, as shown in FIG. 15(*b*), the polarity of the grayscale display voltage is inverted in each frame.

The AC driving, however, is arranged such that, when the polarity of the voltage (grayscale display voltage) applied to each pixel is reversed, a data signal line drive circuit discharges the electric charge on the data signal lines and the pixel capacities by injecting the electric charge with the reverse polarity, and then the data signal line drive circuit is charged up to a desired grayscale display voltage. Because of this arrangement, the AC driving is disadvantageous in that the power consumption for the driving is large.

To solve this problem, for example, Patent Document 2 discloses a source driver which is arranged as follows. The source driver alternates an output signal from an odd-number-th output section of the source driver between a high voltage level and a low voltage level and switches an output voltage supplied from an even-number-th output section in the order in reverse to the odd-number-th output section. In the source driver, a first share line connected to each odd-number-th output section via a switch and a second share line connected to each even-number-th output section via a switch are charged to certain voltage levels, respectively. Before a voltage output from the source driver to an output section is switched between the high voltage level and the low voltage level, the output section is connected to the first or second share line, so that the capacitor of the panel is arranged to be constant.

In other words, in the technology disclosed in Patent Document 2, before the switching of an output voltage supplied to each output section between the high voltage level and the low voltage level, each output section is charged with a constant voltage which has been supplied to the first or second share line. Therefore, the source driver is only required to charge, with the grayscale display voltage, a data line which has already been charged with a certain voltage (of the first or second share line), and hence the power consumption in this case is small as compared to a case where a grayscale display voltage of a low voltage level is charged to a line which has been charged at a high voltage level and a case where a grayscale display voltage of a high voltage level is charged to a line which has been charged at a low voltage level. The technology of Patent Document 2, however, requires to charge the first and second share lines at certain voltages in advance.

Patent Document 3 teaches that output terminals are short-circuited in a blanking period, in a liquid crystal driving apparatus which has plural output terminals which output driving signals to a liquid crystal panel in such a manner that neighboring output terminals output driving signals having inverse polarities, and the polarity of a driving signal output from a single output terminal is inversed in each scanning period.

In other words, in Patent Document 3, for the dot inversion driving, output terminals are short-circuited so that the output terminals have the same electric potential, in a blanking period before the switching of the polarity of each output terminal. As a result of this, the electric potentials of the output terminals, which potentials are identical with one another, are close to the electric potentials after the polarity inversion, and hence the power consumption is small as compared to a case where an electric potential in the previous scanning period is changed to the electric potential with the inverse polarity.

[Patent Document 1]

Japanese Laid-Open Patent Application No. 2005-173573 (published on Jun. 30, 2005)

[Patent Document 2]

Japanese Laid-Open Patent Application No. 2003-228353 (published on Aug. 15, 2003)

[Patent Document 3]

Japanese Laid-Open Patent Application No. 9-212137/1997 (published on Aug. 15, 1997)

DISCLOSURE OF INVENTION

However, when a conventional sub frame display apparatus is driven on AC, the frequency of the reversal of the polarity of a grayscale display voltage is increased as compared to a case where a frame is not time-divided. On this account, the power consumption for the driving is large.

Furthermore, there is a time lag between the input of an image signal into the display apparatus and actual image display, and a frame memory in which the image signal is stored is expensive.

That is to say, in conventional sub frame display, an image signal which is input (i.e. input image signal) is temporarily stored in a frame memory, and a display signal of each sub frame is generated by reading out the stored image signal.

In the aforesaid driving method, a time lag more or less equivalent to one frame period occurs between the input of an image signal and the output of a display signal (constituted by display signals of plural sub frames). This time lag is about 16 ms when, for example, the vertical frequency (frame rate) of the image signal is 60 Hz.

When the display apparatus is used in a television receiver or the like, a time lag between the input of an image signal and the output of a display signal causes a displayed image to be out of sync with sound. Therefore, for example, a circuit for eliminating the out-of sync in sound is required. In case where the display apparatus is used as an image display apparatus of a device such as a PC and a game console, which is required to promptly update the image display in response to an input, image display seriously lags behind the input, and hence the operability is bad.

Furthermore, in the conventional driving method, the image signal of the N-th frame, which has been written in, must be read out (twice) concurrently with the writing of the image signal of the (N+1) frame which is directly subsequent to the N-th frame. Therefore, the memory capacity of the frame memory in which an input image signal is stored must accommodate 2 screens (2 frames) for storing and readout, respectively.

Furthermore, since both of the display signals of the first and second sub frames are generated by reading out an image signal having been stored in the frame memory, the writing of input one screen and the double-speed readout of output 2 screens must be concurrently carried out into/from the frame memory, and hence the required memory band width is large. More specifically, provided that the transmission frequency (dot clock frequency) of an input image signal is F(Hz) and the number of data bits for one pixel is D, the required memory band width for concurrently performing the writing of input one screen and the double-speed readout of output 2 screens is represented as FD+(2F)D*2=5FD(bps).

As the memory band width increases, it is required to increase either the clock frequency for memory access or the number of terminals of the memory, and hence the power consumption and the cost increase.

The present invention was done to solve the problems above, and the objectives of the present invention, which are achieved in a display apparatus which perform AC driving by time-dividing one frame into sub frames, are to reduce a time lag between the input of an image signal and image display, to reduce the cost of a frame memory in which an input image signal is stored, and to reduce the power consumption.

To achieve the objectives above, a display apparatus of the present invention includes: scanning signal lines; data signal lines intersecting with the respective scanning signal lines; and pixels provided at respective intersections of the scanning signal lines and the data signal lines, the display apparatus time-dividing one frame of an input image signal into first to n-th sub frames (n is an integer not less than 2) so as to display an image, the display apparatus further including: signal generation means for generating display signals of the first to n-th sub frames from the input image signal; data signal line drive means for generating grayscale display voltages corresponding to the display signals of the first to n-th sub frames in such a manner that, in each sub frame, grayscale display voltages output to pixels which are neighbored in a direction along the scanning signal lines and to pixels which are neighbored in a direction along the data signal lines are arranged to have inverse polarities and the polarity of a grayscale display voltage which is output to each of the pixels is reversed in each sub frame, in each group of sub frames, or in each frame, and outputting the generated grayscale display voltages to the respective data signal lines; short-circuit means for switching the state of neighboring data signal lines between conduction and cutoff; and timing control means for generating a control signal which causes the pixels to perform image display using the display signals of the first to n-th sub frames, the timing control means causing an image display period of a first sub frame of an N-th frame (N is an integer not less than 2) to partly overlap at least an image display period of a second sub frame of the N-th frame and an image display period of an n-th sub frame of an (N−1)-th frame, so that a period during which the grayscale display voltages are written into all of the pixels in each sub frame is arranged to be equal to an image signal input period of one frame of the input image signal, and the timing control means generating the control signal in such a manner that, when the polarity of a grayscale display voltage which is output from the data signal line drive means to each of the data signal lines is reversed, a grayscale display voltage after polarity inversion is output to each of the data signal lines, after the short-circuit means is kept at the conduction state for a predetermined period of time.

In the arrangement above, when the polarity of the grayscale display voltage output from the data signal line drive means to each of the data signal line is reversed, the short-circuit means is kept at the conduction state for a predetermined period of time, then the grayscale display voltage after the polarity inversion is supplied to each of the data signal lines. That is to say, when the polarity of the grayscale display voltage is reversed, the grayscale signal after the polarity inversion is output after neighboring data signal lines are short-circuited for a predetermined period of time.

As a result of the above, the neighboring data signal lines have been charged with the grayscale display voltages with inverse polarities. Therefore, when the short-circuit means is turned on, the voltages with which the neighboring data signal lines are charged are neutralized (i.e. charge sharing is carried out) so that the data signal lines share the same electric potential. In other words, the polarities are brought close to the grayscale display voltages with inverse polarities, which are to be applied next. It is therefore possible to reduce the power consumption of the data signal line drive means.

Furthermore, in the arrangement above, the image display period of the first frame of an N-th frame (N is an integer not less than 2) is arranged to partly overlap at least the image display period of the second sub frame of the N-th frame and the image display period of an n-th sub frame of an (N−1)-th frame, so that image display operations of plural sub frames are concurrently carried out. It is therefore possible to reduce the required memory capacity of the frame memory in which an input signal is stored for generating a display signal of a sub frame.

An image signal must be stored in a memory (such as frame memory) until the display signal of the sub frame of the last stage is generated. Therefore, when the image display operations of the respective sub frames are serially carried out in such a manner that the image display operation of the second sub frame is carried out after the image display operation of the first sub frame is carried out, the memory is required to store all of the image signals for one frame, until the display signal of the n-th sub frame of the last stage is generated.

On the other hand, when the image display operations of the sub frames are concurrently carried out as in the arrangement above, to the memory area where an image signal for a horizontal line (i.e. pixels on one scanning signal line), from which signal the display signal of the sub frame (n-th sub frame) of the last stage has already been generated, has been written in, it is possible to overwrite an input image signal for another horizontal line. In this way, a memory area can be shared between horizontal lines.

When the memory area is shared in this manner, the required memory capacity is determined by the number of sub frames into which one frame is time-divided. Although being slightly varied depending on the length of the flyback period, the required memory capacity is equivalent to about (N−1)/N frames when the number of sub frames is N. Therefore, the required memory capacity is equivalent to about ½ of one frame when the number of sub frames is 2, and is equivalent to about ⅔ of one frame when the number of sub frames is 3.

Furthermore, in the arrangement above, because the image display operations of plural sub frames are concurrently carried out, a period during which the grayscale display voltages are written into all horizontal lines (all pixels) of the display screen in each sub frame is equal to the image signal input period of one frame of the input image signal. In other words, an input period of the image signal into all horizontal lines is arranged to be equal to a period during which the writing of the grayscale display voltages into all horizontal lines is finished in each sub frame. In this arrangement, when the display signal of the first sub frame is generated, the input image signal can be used as the display signal, without the intermediary of the frame memory. It is therefore possible to shorten a delay time from the input of the image signal of the N-th frame into all horizontal lines to the writing of the grayscale display voltages to the respective horizontal lines in the first sub frame of the N-th frame.

As a result of this, the time lag between the input of the image signal and the actual image display becomes negligibly small. Therefore, there is no gap between a displayed image and sound in a case of a television receiver or the like, and hence a circuit for delaying sound or the like is unnecessary. Also, when the present display apparatus is used as a display apparatus for devices such as PC and game console, which are required to promptly update the screen in response to an input, it is possible to perform image display in which an influence of a time lag on operations is small.

The aforesaid display apparatus may be arranged such that one frame of the input image signal is time-divided into first and second sub frames.

In this case, the polarity of the grayscale display voltage supplied from the data signal line drive means to the data signal line is reversed each time two scanning signal lines are scanned. Since the frequency of the polarity inversion is reduced in this manner, it is possible to effectively reduce the power consumption, as compared to the conventional case where the image display periods of the respective sub frames are arranged not to overlap one another.

The aforesaid display apparatus may be arranged such that the data signal line drive means generates the grayscale display voltages corresponding to the display signals of the first to n-th sub frames in such a way that the polarity of the grayscale display voltage output to each of the pixels is reversed in each sub frame, and the timing control means generates the control signal in such a way that, when image display periods of different sub frames are arranged to overlap one another, an odd-number-th scanning signal line and an even-number-th scanning signal line are alternately scanned.

In this arrangement, the polarity of the grayscale display voltage supplied to the data signal line is reversed for the number identical with the number of the sub frames whose image display periods overlap one another. Since the frequency of the polarity inversion is reduced in this manner, it is possible to effectively reduce the power consumption, as compared to the conventional case where the image display periods of the respective sub frames are arranged not to overlap one another.

The aforesaid display apparatus may be arranged such that the data signal line drive means generates the grayscale display voltages corresponding to the display signals of the first to n-th sub frames in such a way that the polarity of the grayscale display voltage output to each of the pixels is reversed in each frame, and the timing control means generates the control signal in such a way that, when image display periods of different sub frames are arranged to overlap one another, plural odd-number-th scanning signal lines or plural even-number-th scanning signal lines are successively scanned.

Since this arrangement makes it possible to reduce the frequency of the reversal of the polarity of the grayscale display voltage supplied to the data signal line, the power consumption is reduced.

The aforesaid display apparatus may be arranged such that the timing control means generates the control signal in such a way that the short-circuit means is not changed to the cutoff state when the polarity of the grayscale display voltage output from the data signal line drive means to each of the data signal lines is not reversed.

In this arrangement, when the polarity of the grayscale display voltage which is supplied from the data signal line drive means to the data signal line is not reversed, a period in which the data signal lines are short-circuited is not provided. It is therefore possible to extend the image display period (a period in which charging of the grayscale display voltage is performed), as compared to a case where data signal lines are short-circuited each time one scanning signal line is scanned.

The aforesaid display apparatus may be arranged such that the timing control means generates the control signal in such a way that, when the polarity of the grayscale display voltage output from the data signal line drive means to each of the data signal line is not reversed, the short-circuit means is turned on for a period shorter than the predetermined period and then the grayscale display voltage is output to each of the data signal lines.

In this arrangement, the short-circuit period of the data signal lines in case where the polarity of the grayscale display voltage output from the data signal line drive means to each of the data signal line is not reversed is shortened as compared to the case of the polarity inversion. It is therefore possible to elongate the image display period as compared to the case where the data signal lines are short-circuited for the same period of time each time one scanning signal line is scanned.

The aforesaid display apparatus may be arranged such that the timing control means controls the short-circuit means by using a latch pulse which is a control signal for controlling a timing to output the grayscale display voltage from the data signal line drive means to each of the data signal line.

In this arrangement, it is unnecessary to additionally use a control signal for controlling the short-circuit means. It is therefore possible to simplify the timing control means.

The aforesaid display apparatus may be arranged such that, when the polarity of the grayscale display voltage output from the data signal line drive means to each of the data signal lines is reversed, the timing control means arranges an active period of the latch pulse to be longer than an active period in a case where the polarity is not reversed, and the short-circuit means causes neighboring data signal lines to be electrically connected, during the active period of the latch pulse.

In this arrangement, the short-circuit period of the data signal lines, in case where the polarity of the grayscale display voltage output from the data signal line drive means to each of the data signal line is not reversed, is shortened as compared to the case of the polarity inversion. It is therefore possible to elongate the image display period as compared to the case where the data signal lines are short-circuited for the same period of time each time one scanning signal line is scanned.

The aforesaid display apparatus may be arranged such that the timing control means generates the timing signal so that image display periods of respective sub frames have a substantially equal length.

In this arrangement, the length of the image display period when the polarity of the grayscale display voltage supplied from the data signal line drive means to the data signal line is reversed is arranged to be substantially identical with the length of the image display period when the polarity is not reversed. In other words, the length of the image display period, which is elongated because a period in which data signal lines are not short-circuited is not provided in the sub frame in which the polarity of the grayscale display voltage output from the data signal line drive means to the data signal line is not reversed, is distributed to each sub frame. As a result, the length of the image display period of each sub frame is arranged to be longer than the length in the case where the data signal lines are short-circuited each time one scanning signal line is scanned.

The aforesaid display apparatus may be arranged such that the timing control means generates, for each of the scanning signal lines, the control signal in such a way that the grayscale display voltage corresponding to the display signal of each of the first to n-th sub frames is output from the data signal line drive means in a time division manner, and a selection signal is output from scanning signal line drive means in accordance with the output of the grayscale display voltage.

For example, provided that there are 100 scanning signal lines and one frame is divided into first and second sub frames, the data signal line drive circuit first outputs, to respective data signal lines, voltage values corresponding to the display signal of the first sub frame of the N-th frame for the pixels on the first scanning signal line, then outputs voltage values corresponding to the display signal of the second sub frame of the (N−1)-th frame for the pixels on the 51st scanning signal line, and then outputs voltage values corresponding to the display signal corresponding to the first sub frame of the N-th frame for the pixels on the second scanning signal line. In this way, for each scanning signal line, the display signal of each sub frame is output in a time division manner.

In the meanwhile, in response to the output from the data signal line drive circuit, the scanning signal line driving circuit outputs a selection signal while serially (alternately in this case) switching a group of scanning signal line to be selected. The scanning signal lines are vertically grouped such that the first scanning signal line, the 51st scanning signal line, the second scanning signal line, the 52nd scanning signal line, and so on.

As a result, without using a display module whose display screen is divided and each sub screen can independently perform image display, it is possible to simultaneously perform image display operations of plural sub frames by virtually dividing the screen into two screens, using a typical display module whose screen is not divided.

The aforesaid display apparatus may be arranged such that the timing control means generates the control signal in such a way that a delay time from the input of the image signal of the N-th frame into each of the scanning signal lines to the writing of the grayscale display voltage in the first sub frame of the N-th frame is arranged to be shorter than the half of one frame of the input image signal.

In this arrangement, a time lag between the input of the image signal and the actual image display is arranged to be negligibly short. For this reason, there is no gap between a displayed image and sound in a case of a television receiver or the like, and hence a circuit for delaying sound or the like is unnecessary. Also, when the present display apparatus is used as a display apparatus for devices such as PC and game console, which are required to promptly update the screen in response to an input, it is possible to perform image display in which an influence of a time lag on operations is small. Note that it is further preferably that the control signal is generated in such a way that the delay time is shorter than 20% of one frame period of the input image signal.

The aforesaid display apparatus may be arranged to further include memory control means for controlling writing and readout into/from a frame memory which stores the input image signal, when a display signal of the n-th sub frame is generated for a pixel, the memory control means writes, into an area of the frame memory in which area the image signal for the pixel has been stored, an input image signal for another pixel.

In this arrangement, it is possible to use a memory with a small capacity, as a frame memory in which an input image signal is stored. Alternatively, because the memory is capacious, it is possible to provided another function (e.g. overshoot driving for the sake of improvement in the moving image response) in a blank address space of the memory.

The aforesaid display apparatus may be arranged such that the signal generation means generates the display signal of the first sub frame from the input image signal without the intermediary of a frame memory in which the input image signal is stored, and generates the display signals of the second to n-th sub frames by reading out the image signal stored in the frame memory.

Since this arrangement makes it possible to reduce the frequency of the access (writing and readout) to the frame memory, it is possible to reduce the memory band width of the frame memory. It is noted that the conversion of the transmission frequency is carried out such that an input image signal is written into a line memory or the like and the signal is read out so that a required transmission frequency is achieved.

To achieve the objectives above, a display method of the present invention is arranged such that, in a display apparatus including: scanning signal lines; data signal lines intersecting with the respective scanning signal lines; and pixels provided at respective intersections of the scanning signal lines and the data signal lines, one frame of an input image signal is time-divided into first to n-th sub frames (n is an integer not less than 2) so that an image is displayed on the pixels, an image display period of a first sub frame of an N-th frame (N is an integer not less than 2) being arranged to partly overlap at least an image display period of a second sub frame of the N-th frame and an image display period of an n-th sub frame of an (N−1)-th frame, so that a period during which the grayscale display voltages are written into all of the scanning signal lines of a display screen in each sub frame is arranged to be equal to an image signal input period of one frame of the input image signal, and when the polarity of a grayscale display voltage which is output from the data signal line drive means to each of the data signal lines is reversed, a grayscale display voltage after polarity inversion is output to each of the data signal lines, after neighboring data signal lines are short-circuited for a predetermined period of time.

In this method, when the polarity of the grayscale display voltage output to the data signal line is reversed, neighboring data signal lines are short-circuited for a predetermined period of time, and then the grayscale display voltage after the polarity inversion is output to each data signal line.

As a result of the above, the neighboring data signal lines have been charged with the grayscale display voltages with inverse polarities. Therefore, when the neighboring data signal lines are short-circuited, the voltages with which the neighboring data signal lines are charged are neutralized (i.e. charge sharing is carried out) so that the data signal lines share the same electric potential. In other words, the polarities are brought close to the grayscale display voltage with inverse polarities, which are to be applied next. It is therefore possible to reduce the power consumption for charging the pixels with the grayscale display voltages.

Furthermore, in the method above, the image display period of the first sub frame of an N-th frame (N is an integer not less than 2) is arranged to partly overlap at least the image display period of the second sub frame of the N-th frame and the image display period of an n-th sub frame of an (N−1)-th frame, so that image display operations of plural sub frames are concurrently carried out. It is therefore possible to reduce the required memory capacity of the frame memory in which an input signal is stored for generating a display signal of a sub frame.

Furthermore, in the arrangement above, because the image display operations of plural sub frames are concurrently carried out, a period during which the grayscale display voltages are written into all horizontal lines (all pixels) of the display screen in each sub frame is equal to the image signal input period of one frame of the input image signal. In this arrangement, when the display signal of the first sub frame is generated, the input image signal can be used as the display signal, without the intermediary of the frame memory. It is therefore possible to shorten a delay time from the input of the image signal of the N-th frame into all horizontal lines to the writing of the grayscale display voltages to the respective horizontal lines in the first sub frame of the N-th frame.

As a result of this, the time lag between the input of the image signal and the actual image display becomes negligibly small. Therefore, there is no gap between a displayed image and sound in a case of a television receiver or the like, and hence a circuit for delaying sound or the like is unnecessary. Also, when the present display apparatus is used as a display apparatus for devices such as PC and game console, which are required to promptly update the screen in response to an input, it is possible to perform image display in which an influence of a time lag on operations is small.

The aforesaid method may be arranged such that one frame of the input image signal is time-divided into first and second sub frames.

In this case, the polarity of the grayscale display voltage supplied to the data signal line is reversed each time two scanning signal lines are scanned. Since the frequency of the polarity inversion is reduced in this manner, it is possible to effectively reduce the power consumption, as compared to the conventional case where the image display periods of the respective sub frames are arranged not to overlap one another.

The aforesaid method may be arranged such that the grayscale display voltages corresponding to the display signals of the first to n-th sub frames are generated in such a way that the polarity of the grayscale display voltage output to each of the pixels is reversed in each sub frame, and when image display periods of different sub frames are arranged to overlap one another, an odd-number-th scanning signal line and an even-number-th scanning signal line are alternately scanned.

In this method, the polarity of the grayscale display voltage supplied to the data signal line is reversed for the number identical with the number of the sub frames whose image display periods overlap one another. Since the frequency of the polarity inversion is reduced in this manner, it is possible to effectively reduce the power consumption, as compared to the conventional case where the image display periods of the respective sub frames are arranged not to overlap one another.

The aforesaid method may be arranged such that the grayscale display voltages corresponding to the display signals of the first to n-th sub frames are generated in such a way that the polarity of the grayscale display voltage output to each of the pixels is reversed in each frame, and when image display periods of different sub frames are arranged to overlap one another, plural odd-number-th scanning signal lines or plural even-number-th scanning signal lines are successively scanned.

Since this arrangement makes it possible to reduce the frequency of the reversal of the polarity of the grayscale display voltage supplied to the data signal line, the power consumption is reduced.

It is possible to constitute a display monitor by combining the display apparatus of the present invention with signal input means for transmitting an externally-input image signal to the display apparatus. Also, the aforesaid display apparatus may be used as a display apparatus of a television receiver.

BRIEF DESCRIPTION OF DRAWINGS

FIG. 14(*b*) explains why motion blur is restrained in the display apparatus of the embodiment of the present invention, and shows how the border between two areas with different brightness moves while impulse-type display is carried out.

FIG. 15(*b*) is a timing chart showing the relationship among the grayscale display voltages applied to the respective pixels and time, in the conventional liquid crystal display apparatus shown in FIG. 15(*a*).

BEST MODE FOR CARRYING OUT THE INVENTION

The following will explain an embodiment of the present invention. A display apparatus 1 of the present invention (hereinafter, present display apparatus) carries out the driving with time-division of a single frame into plural sub frames. In the present display apparatus, in each sub frame, the polarities of grayscale display voltages applied to the pixels neighbored in the horizontal direction (direction along gate signal lines) and in the vertical direction (direction along data signal lines) are arranged to be different, and the polarity of the grayscale display voltage applied to each pixel is reversed in each sub frame. In this display apparatus, moreover, a time lag between an input of an image signal and image display is short and a frame memory in which the input image signal is stored is low-cost.

The present display apparatus can be suitably used, for example, as a television receiver or a display monitor connected to a personal computer. Examples of television broadcasts that television receivers receive include terrestrial television broadcasts, broadcasts using satellites, such as BS (Broadcasting Satellite) digital broadcasts and CS (Communication Satellite) digital broadcasts, and cable television broadcasts.

Figure 2:
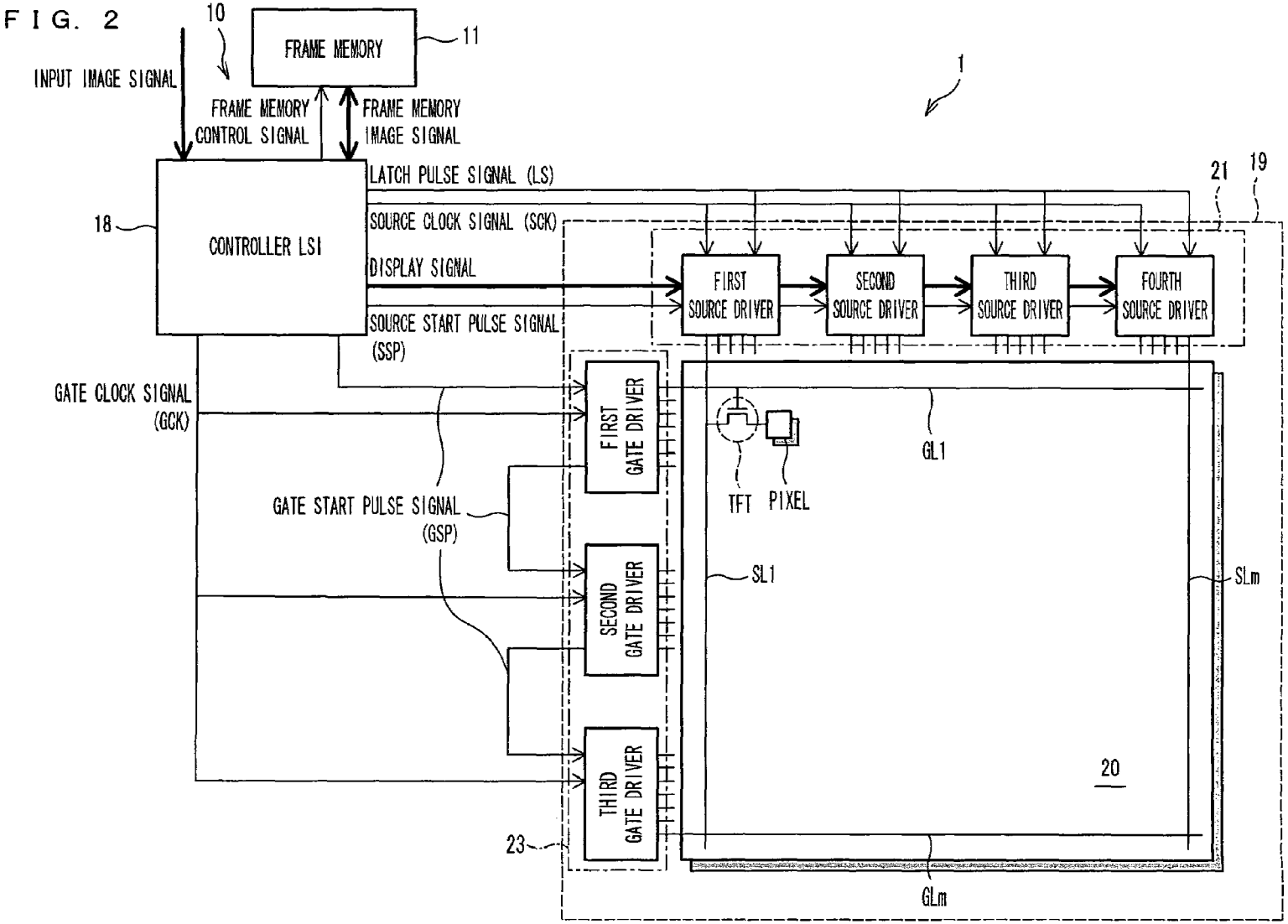
FIG. 2 is a block diagram showing the substantial part of the display apparatus of the embodiment of the present invention.

FIG. 2 is a block diagram showing a substantial part of the present display apparatus. As shown in this figure, the present display apparatus includes a display module 19 and a control apparatus (driving control apparatus) 10. The display module 19 is chosen from hold-type display modules such as an EL display module and a liquid crystal display module. In the present display apparatus, the display module 19 is a liquid crystal display module.

The display module 19 includes a pixel array 20 with plural pixels provided in a matrix manner. The pixels are provided at the intersections between data signal lines SL1-SLn and gate signal lines (scanning signal lines) GL1-GLm. Along with the pixel, an active element is provided at each intersection. To each pixel (more precisely, to each pixel electrode), a voltage having been applied to a corresponding data signal line SL is supplied, during a period in which a corresponding gate signal line GL is selected by an active element (TFT in the figure).

Around the pixel array 20, there are a source driver section (data signal line driving circuit) 21 driving the data signal lines SL1-SLn and a gate driver section (scanning signal line driving circuit) 23 driving the gate signal lines GL1-GLm.

The gate driver section 23 outputs, to each of the gate signal lines GL1-GLm, a signal indicating a selection period, such as a voltage signal. In doing so, the gate driver section 23 selects a gate signal line GL to which the signal indicating the selection period is output, based on timing signals such as a gate clock signal GCK and a gate start pulse GSP which are control signals supplied from the control apparatus 10. In this manner, each of the gate signal lines GL1-GLm is selected and driven at a predetermined timing.

The gate driver section 23 of the present display apparatus has a clock skip mode in which the gate signal lines are not serially turned on at input timings of the gate clock signal GCK. In the clock skip mode, after the first gate signal line GL is changed to be active at one gate clock, the gate signal line of the next stage is changed to be active at a gate clock which is input after g (g is an integer not less than 2) clocks are counted after the input of said one gate clock. This clock skip mode will be discussed later.

On the other hand, the source driver section 21 drives the data signal lines SL1-SLn so as to supply voltages indicated by display signals to the data signal lines SL1-SLn. In doing so, the source driver section 21 extracts the display signals which are input from the control apparatus 10 to the respective pixels in a time-division manner, by, for example, sampling the display signals at predetermined timings. The source driver section 21 then outputs, via the data signal lines SL1-SLn, an output signal corresponding to the display signal, to the pixel associated with the gate signal line GL having been selected.

In addition to the above, the source driver section 21 determines the timings of the sampling and the timings of the output of the output signals, based on timing signals such as a source clock signal SCK, a source start pulse SSP, and a latch pulse LS, which are control signals supplied from the control apparatus 10.

Each pixel in the pixel array 20 determines, when the corresponding gate signal line GL is selected, its brightness by adjusting the luminance, transmittance and the like when emitting light. The determination is made in accordance with an output signal supplied to the corresponding one of the data signal lines SL1-SLn.

In the present display apparatus, each of the source driver section 21 and the gate driver section 23 is constructed by cascading plural chips.

The source driver section 21 is constructed by cascading first to fourth source drivers each of which is constituted by a single chip. Each of the first to fourth source drivers drives n/4 of n data signal lines SL of the pixel array 20.

The display signal and the source start pulse SSP are supplied from the control apparatus 10 to the first source driver, and these signals are then passed to the second source driver, the third source driver, and the fourth source driver in this order. The source clock signal SCK and the latch pulse signal LS are supplied from the control apparatus 10 to first to fourth source drivers, in a shared manner.

In each sub frame, the source driver section 21 generates grayscale display voltages supplied to the respective pixels in such a way that the polarities of the grayscale display voltages applied to the pixels neighbored in the horizontal direction (direction along gate signal lines) and in the vertical direction (direction along data signal lines) are differentiated and the polarity of the grayscale display voltage applied to each pixel is reversed in each frame. A timing to reverse the polarity of the grayscale display voltage applied to each pixel is controlled based on a polarity inversion signal REV which is a control signal supplied from the control apparatus 10. Furthermore, in the source driver section 21, when the polarity of the grayscale display voltage applied to each pixel is reversed, after the potentials of the neighboring data signal lines are neutralized (i.e. charge sharing is carried out) by short-circuiting the data signal lines, the grayscale display voltages with the reverse potentials are output to the data signal lines. How the source driver section 21 will be explained later.

The gate driver section 23 is constructed by cascading first to third gate drivers each of which is constituted by a single chip, and each of the first to third gate drivers drives 3/m of m gate signal lines GL of the pixel array 20.

The gate start pulse GSP is supplied from the control apparatus 10 to the first gate driver, and is then passed to the second gate driver and the third gate driver in this order. The gate clock signal GCK is supplied from the control apparatus 10 to the first to third gate drivers, in a shared manner.

The control apparatus 10 controls the display operation of the display module 19. Using an image signal (input image signal) and a control signal (input control signal) supplied from the outside, the control apparatus 10 outputs a display signal for driving the display module 19 and control signals such as the aforesaid source clock signal SCK and the source start pulse SSP.

The present display apparatus performs sub frame display so that one frame is time-divided into sub frames. Therefore, the control apparatus 10 generates a display signal supplied to the display module 19, as display signals for plural sub frames. The number of the sub frames in this embodiment is 2, and the temporally earlier sub frame is termed a first sub frame, whereas the temporally later sub frame is termed a second sub frame.

Furthermore, in the present display apparatus, an image display period (charging period) of the first sub frame of the N-th frame is arranged to partly overlap an image display period of the second sub frame of the N-th frame and an image display period of the second sub frame of the (N−1)-th frame, so that a period during which grayscale display voltages (pixel voltages) are written into all horizontal lines of the display screen in each sub frame is arranged to be identical with an image signal input period of one frame, during which an image signal is input. Furthermore, a delay time from the input of the image signal of the N-th frame into each horizontal line to the writing of the grayscale display voltage into each horizontal line in the first sub frame of the N-th frame is arranged to be shorter than the half of one frame of the input image signal. In the present embodiment, as a preferable arrangement, the delay time is arranged to be shorter than 20% of one frame of the input image signal. The control apparatus 10 generates and outputs the control signals in such a way as to cause the display module 19 to carry out the above-described image display operation.

In case where the number of sub frames is, for example, 4, an image display period of the first sub frame of the N-th frame partly overlaps respective image display periods of the second sub frame of the N-th frame, the third sub frame of the N-th frame, the third sub frame of the (N−1)th frame, and the fourth sub frame (last-stage sub frame) of the (N−1)th frame. This may not hold true depending on the timings at which the respective sub frames start.

An image signal source from which the input image signal and the input control signals are supplied to the aforesaid control apparatus 10 is, for example, a tuner (image receiving means) which receives a television broadcast and generates an image signal representing an image transmitted by a television broadcast. In case where the present display apparatus is a display monitor, the image signal source is, for example, a personal computer.

Figure 3:
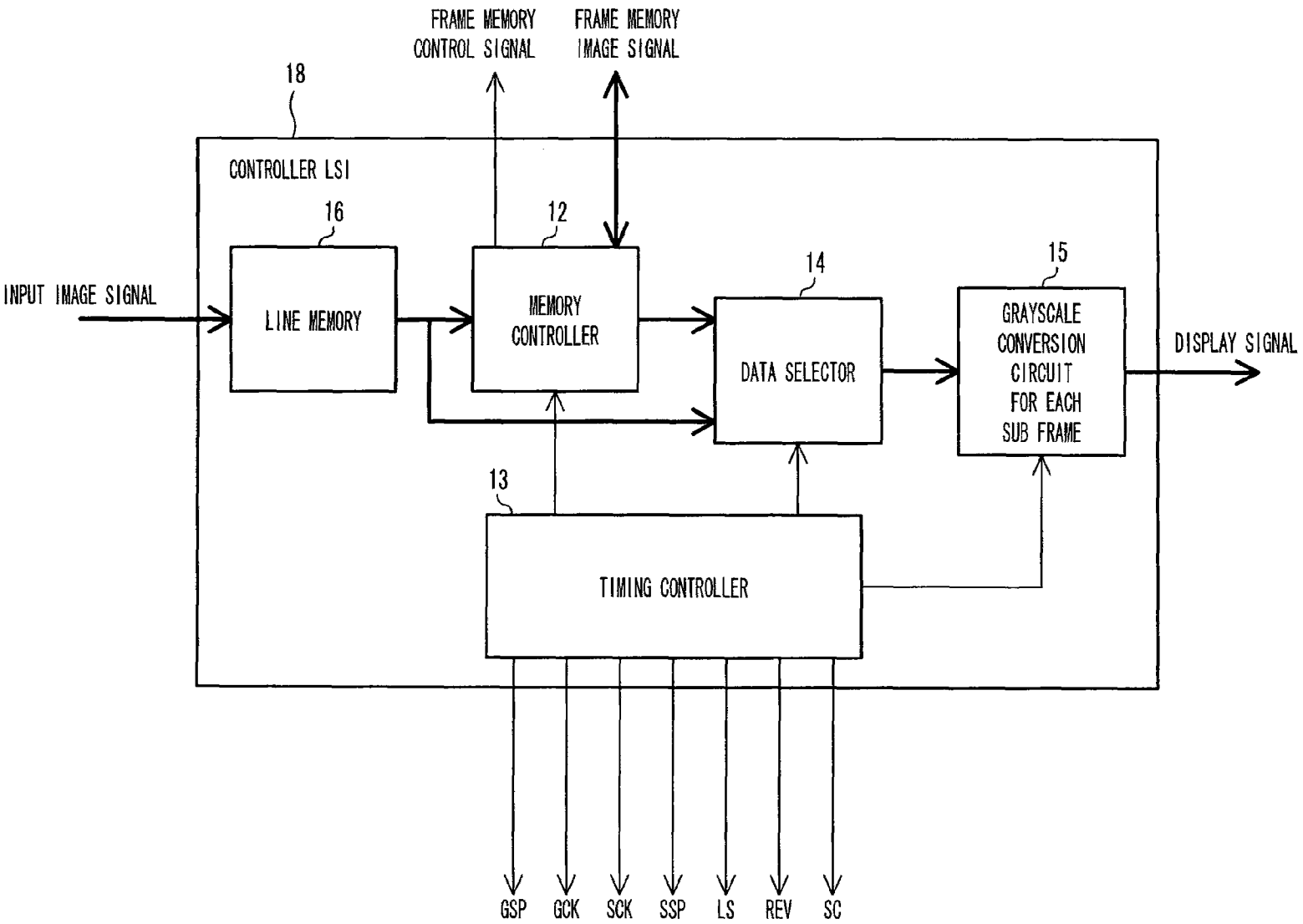
FIG. 3 is a block diagram which outlines a controller LSI.

Now, details of the arrangement and the operation of the control apparatus 10 will be given. As shown in FIG. 2, the control apparatus 10 of the present display apparatus includes a frame memory 11 and a controller LSI 18. FIG. 3 is a block diagram outlining the controller LSI 18. As shown in this figure, the controller LSI 18 includes a line memory 16, a memory controller 12, a timing controller 13, a data selector 14, and a grayscale conversion circuit 15 for each sub frame.

The image signal (input image signal) supplied from the image signal source is written, in a line-by-line (each of the horizontal lines) manner, into the line memory 16 on the input stage of the controller LSI 18. The image signal thus written is read out at the doubled transmission frequency for the sake of a time division transmission process later, and then the signal is transmitted to the memory controller 12 and the data selector 14.

The memory controller 12 controls writing and readout into/from the frame memory 11. The memory controller 12 writes an image signal read out from the line memory 16 into the frame memory 11 in a line-by-line manner, and concurrently reads out the image signal from the frame memory 11 in a time-division manner and sends the image signal thus read out to the data selector 14.

The data selector 14 selects an image signal supplied from the line memory 16 in case where an image signal corresponding to the first sub frame is to be output, and selects an image signal read out from the frame memory 11 when an image signal corresponding to the second sub frame is to be output.

The grayscale conversion circuit 15 for each sub frame generates, for example, from an input image signal, display signals for plural sub frames in order to restrain motion blur, and outputs the generated signals to the display module 19.

The grayscale conversion circuit 15 for each sub frame converts a grayscale of an image signal supplied from the data selector 14, by using an LUT (Look-up Table) or the like. The number of the LUT is determined in accordance with the number of sub frames. For the first sub frame and the second sub frame, the number of the LUT in this case is 2. The details of the generation of the display signal of each sub frame by the grayscale conversion circuit 15 will be given later.

The operations above, such as the readout of an image signal from the line memory 16, the access to the frame memory 11 by the memory controller 12, and the operation timings of the data selector 14 and the grayscale conversion circuit 15 for each sub frame, are controlled by the timing controller 13. This timing controller 13 controls not only the output of a display signal generated by the grayscale conversion circuit 15 for each sub frame but also the output of the aforesaid control signals (clock signal SCK, start pulse SSP, latch pulse LS, gate clock signal GCK, gate start pulse GSP, polarity inversion signal REV, and short-circuit control signal SC) supplied to the display module 19.

Figure 4:
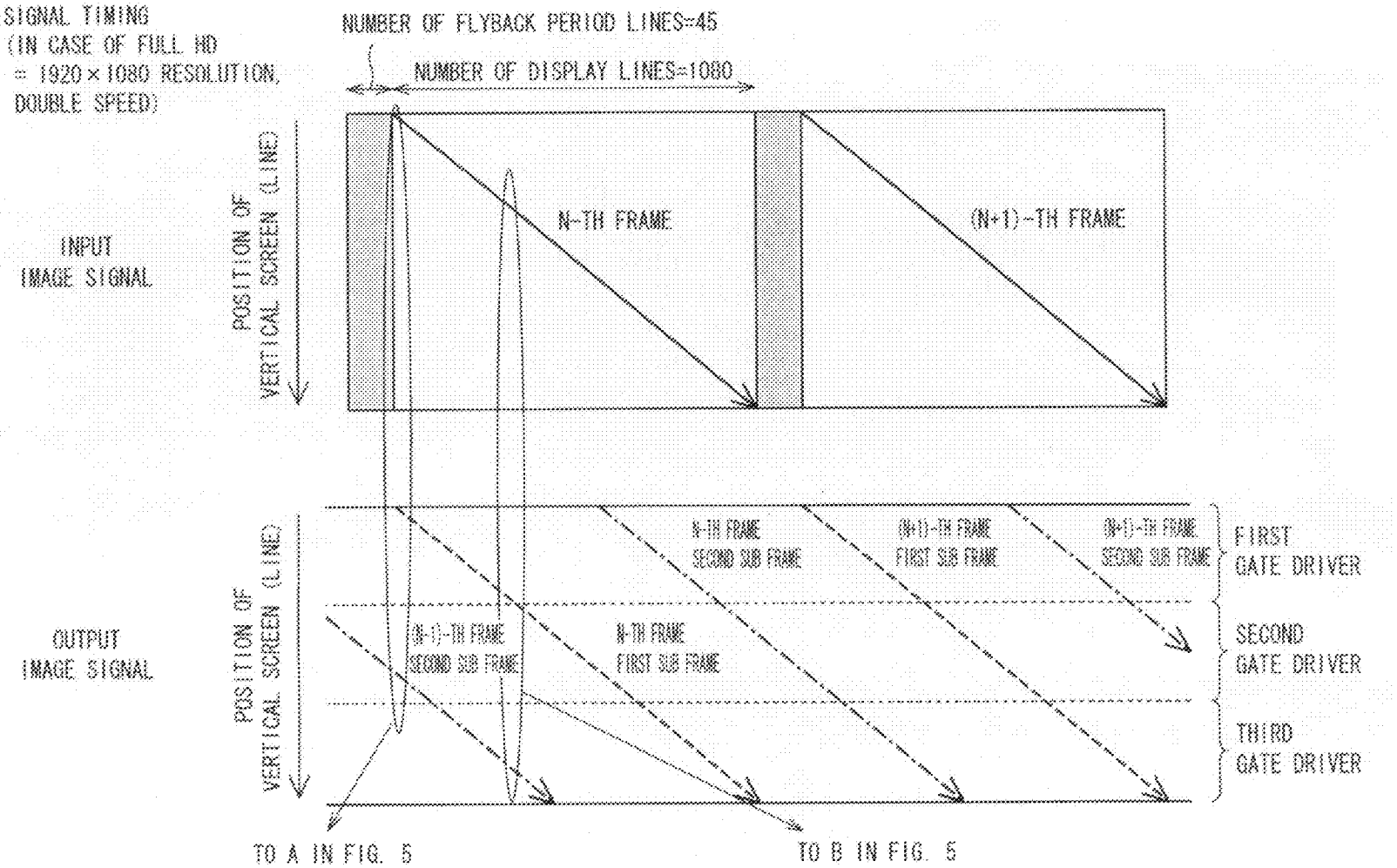
FIG. 4 illustrates the relationship between an input image signal and an output display signal which is output from a control device of the display apparatus of the embodiment of the present invention.

FIG. 4 shows the relationship on the time axis between an image signal input to the control apparatus 10 and a display signal output from the control apparatus 10. In this case, one frame of the input image signal is constituted by 1080 display lines (horizontal lines) and 45 vertical flyback time lines.

In the present display apparatus, an image of the N-th frame is generated by image display in the first sub frame and image display in the second sub frame. As shown in FIG. 4, image display of the first sub frame of the N-th frame is carried out concurrently with the second-half display of the second sub frame of the (N−1)-th frame which is the directly preceding frame, and the second-half display of the first sub frame of the N-th frame is carried out concurrently with the first-half display of the second sub frame of the N-th frame.

In this case, the vertical display operation period of each sub frame is identical with the vertical input period of one frame (i.e. one frame period) of an input image signal. Also in this case, the image display operation of the first-stage sub frame is carried out for all pixels of the display screen, with a minimum delay from the input of image signals into the respective pixels.

Figure 5:
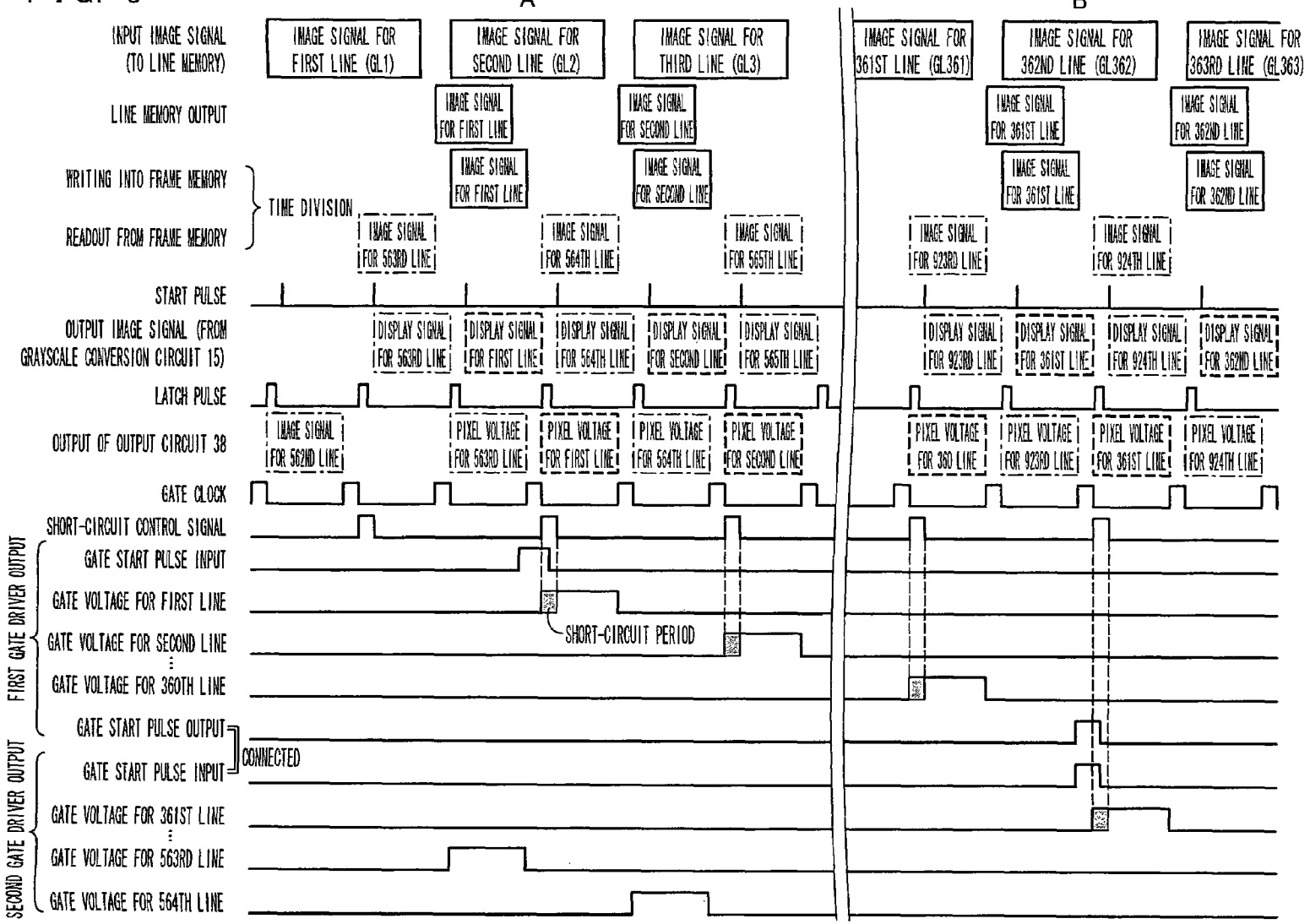
FIG. 5 illustrates the relationship on the time axis among image signals which are dealt with in the display apparatus of the embodiment of the present invention.
Figure 6:
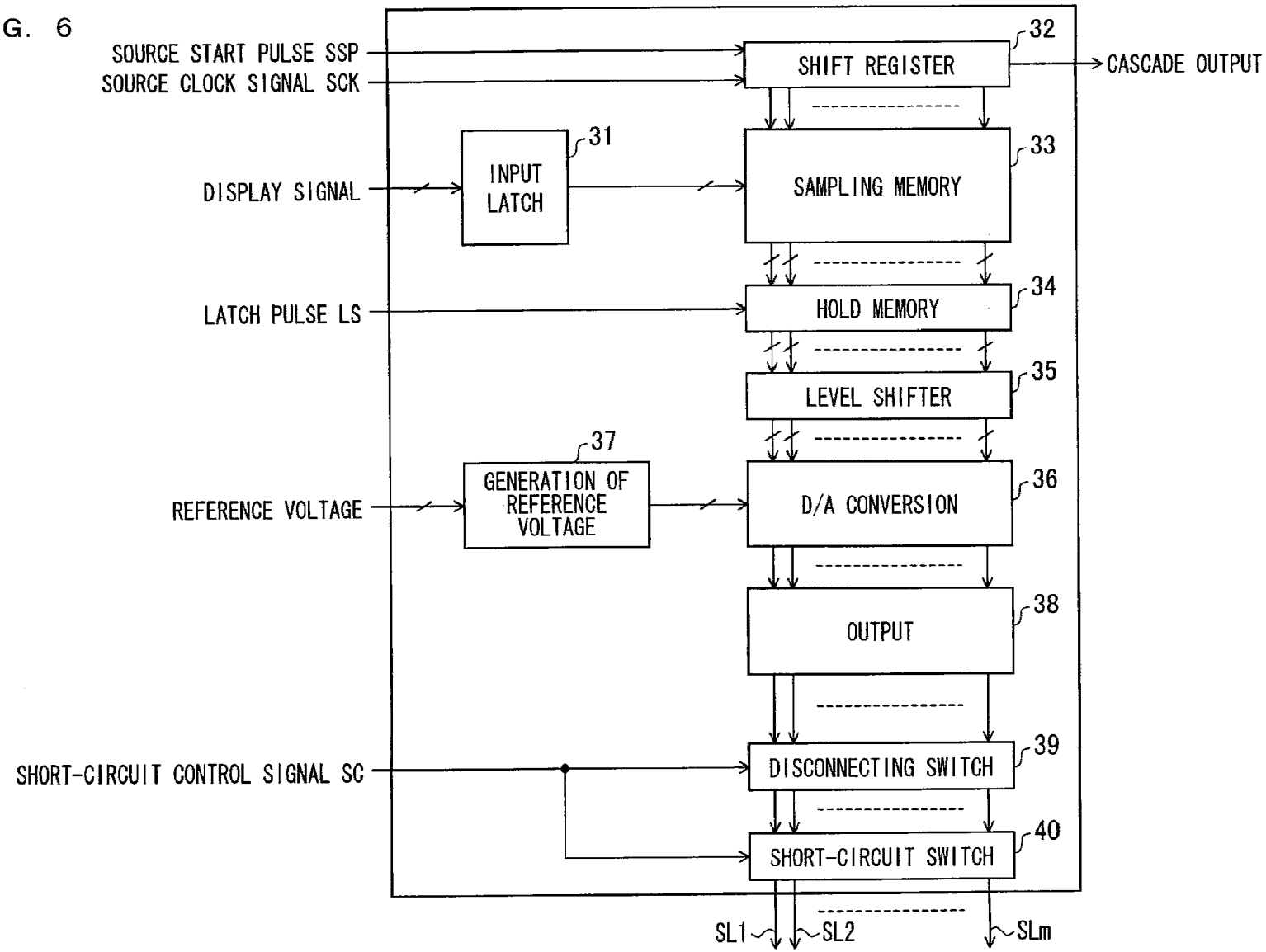
FIG. 6 is a block diagram showing an example of a source driver section of the display apparatus of the embodiment of the present invention.

FIG. 5 illustrates the sections of the control apparatus 10 and the operation timings of the source driver section 21 and the gate driver section 23 of the display module 19, in case where the display operation of the first sub frame of the N-th frame is performed concurrently with the display operation of the second sub frame of the (N−1)-th frame. FIG. 6 is a block diagram showing an example of the source driver section 21.

The controller LSI 18 outputs, to the source driver section 21, a display signal, a source start pulse SSP, a source clock signal SCK, a latch pulse LS, a polarity inversion signal REV, and a short-circuit control signal SC. The display signal having been output to the source driver section 21 is input to an input latch circuit 31 and latched therein. In the meanwhile, in sync with the source clock signal SCK, the source start pulse SSP is serially transferred in a shift register 32. In response to control signals which are output from the respective stages of the shift register 32, the display signal output from the input latch circuit 31 is fetched by a sampling memory 33 in a time-division manner, and the display signal is temporarily stored therein. Thereafter, at a timing indicated by the latch pulse LS, i.e. when display data for one line is fetched in the sampling memory 33, the display signal stored in the sampling memory 33 is stored in the hold memory 34 altogether and is latched. The latch of the display signal is maintained until the next input of the latch pulse LS.

The display signal latched by the hold memory 34 is level-shifted by a level shifter 35 so as to have a maximum drive voltage level that the display module 19 can accept, and a voltage corresponding to the display signal is selected from grayscale display voltages (e.g. 256-level voltages for image display with 256 grayscales) applied to the data signal lines SL1-SLn of the display module 19, which are generated by a reference voltage generation circuit 37 based on plural reference voltages output from a liquid crystal driving source (not illustrated). A D/A conversion circuit 36 arranges the grayscale display voltages, which are applied to data signal lines which are neighbored in the horizontal direction (direction along the gate signal lines), to have reverse polarities.

The grayscale display voltages output from the D/A conversion circuit 36 are supplied to the data signal lines SL1-SLn via an output circuit 38. Between the output circuit 38 and each data signal line, disconnecting switches 39 and short-circuit switches 40 are provided.

Figure 7:
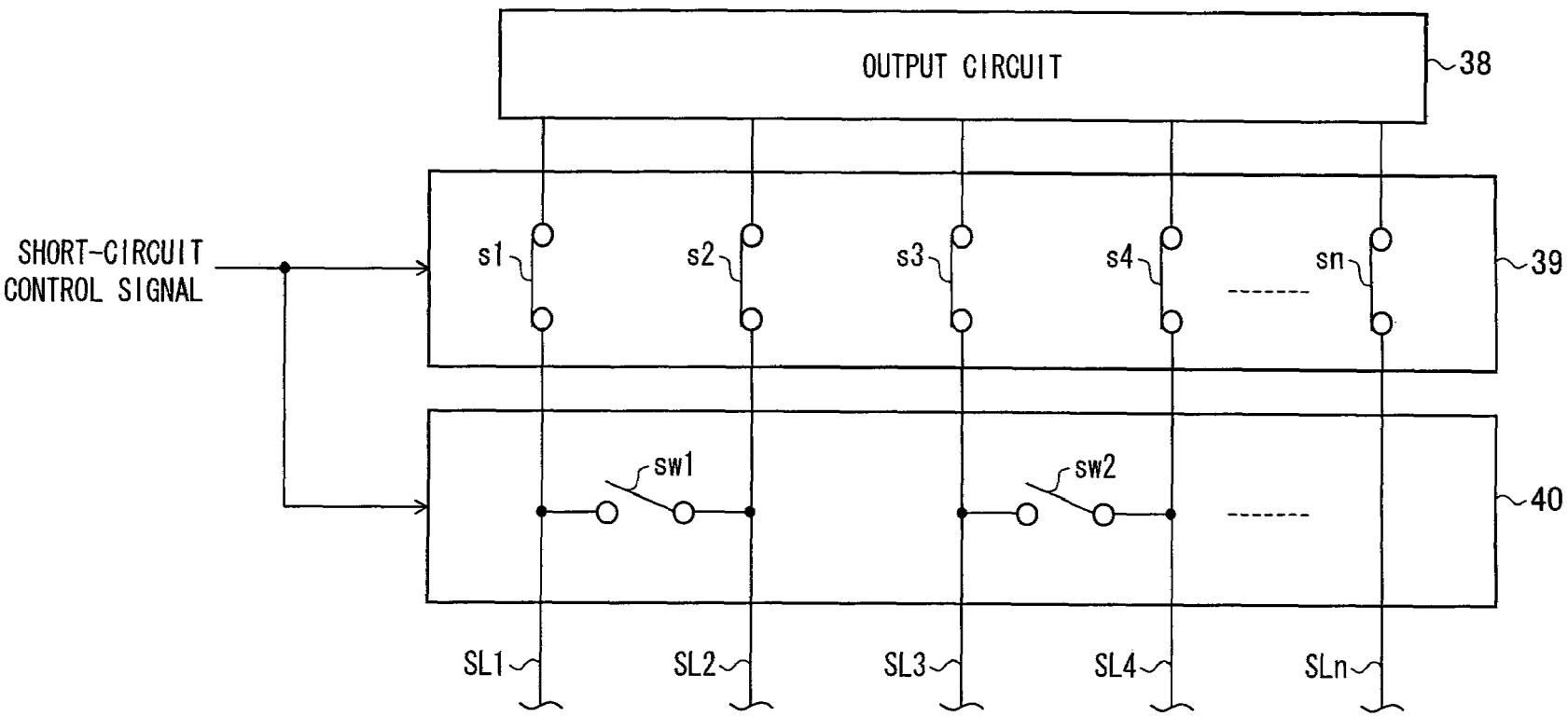
FIG. 7 is a circuit diagram showing an example of disconnecting switches and short-circuit switches in the source driver section of the display apparatus of the embodiment of the present invention.

FIG. 7 is a circuit diagram showing an example of the disconnecting switches 39 and the short-circuit switches 40. As shown in this figure, the disconnecting switches 39 are constituted by disconnecting switches s1-sn which are connected in series with the data signal lines SL1-SLn, respectively.

The short-circuit switches 40 are constituted by short-circuit switches sw1, sw2, and so on, each of which is provided to connect two neighboring data signal lines. The short-circuit switches 40 are not necessarily arranged in this way. For example, a short-circuit switch may be provided to short-circuit any 3 or more data signal lines or to short-circuit all data signal lines.

Non-limiting examples of the disconnecting switch and the short-circuit switch include analog switches such as MOS transistor and transmission gate. Each disconnecting switch and each short-circuit switch can switch between conduction and cutoff, in accordance with the short-circuit control signal SC supplied from the controller LSI 18. The timing controller 13 of the controller LSI 18 generates the short-circuit control signal SC in such a way as to turn off each disconnection switch and turn on each short-circuit switch for a predetermined period of time, each time the polarity of the grayscale display voltage applied to each data signal line is reversed. Except during the predetermined period of time, each disconnecting switch is turned on whereas each short-circuit switch is turned off.

As shown in FIG. 5, when the controller LSI 18 receives the image signal of the first line (gate signal line) GL1 of the N-th frame, the output circuit 38 of the source driver section 21 (first to fourth source drivers) outputs a grayscale display voltage corresponding to the display signal for the pixels corresponding to the first line GL1 of the first sub frame of the N-th frame, as a result of the operations explained above. In the present display apparatus, at the latch pulse LS which is input after two pulses are counted after the completion of the input of the image signal of the first line of the N-th frame, the output circuit 38 of the first to fourth source drivers outputs a grayscale display voltage corresponding to the display signal for the pixels on the first line GL1 of the first sub frame of the N-th frame.

Immediately before this, the controller LSI 18 outputs the gate start pulse GSP as well as the gate clock signal GCK. As a result, the first line GL1 of the pixel array 20 connected to the first gate driver is changed to be active, and the TFTs of the pixels on this first line GL1 are turned on.

Furthermore, at the same time as the latch pulse LS which is input after two pulses are counted after the completion of the input of the image signal of the first line of the N-th frame is changed to be active, the controller LSI 18 changes the short-circuit control signal SC to be active. As a result of this, each disconnecting switch is turned off whereas each short-circuit switch is turned on, so that neighboring data signal lines are short-circuited. At this moment, since the neighboring data signal lines are charged with grayscale display voltages with inverse polarities, the voltages with which the data signal lines are charged are neutralized (charge-shared) on account of the turn-on of the short-circuit switch, with the result that the data signal lines share the same electric potential. Thereafter, when the short-circuit control signal SC is changed to be inactive, each disconnecting switch is turned on whereas each short-circuit switch is turned off, and hence the grayscale display voltage output from the output circuit 38 is supplied to each data signal line.

The length of the period during which the short-circuit control signal SC is set to be active, i.e. the length of the short-circuit period during which neighboring data signal lines are short-circuited is preferably minimum on condition that the voltages with which the data signal lines are charged are properly neutralized. This is because, when the short-circuit period is too long, the period during which image display is carried out by charging each pixel with the grayscale display voltage is short and hence the image display may not be properly carried out. The short-circuit period is typically several μs or less.

Figure 8:
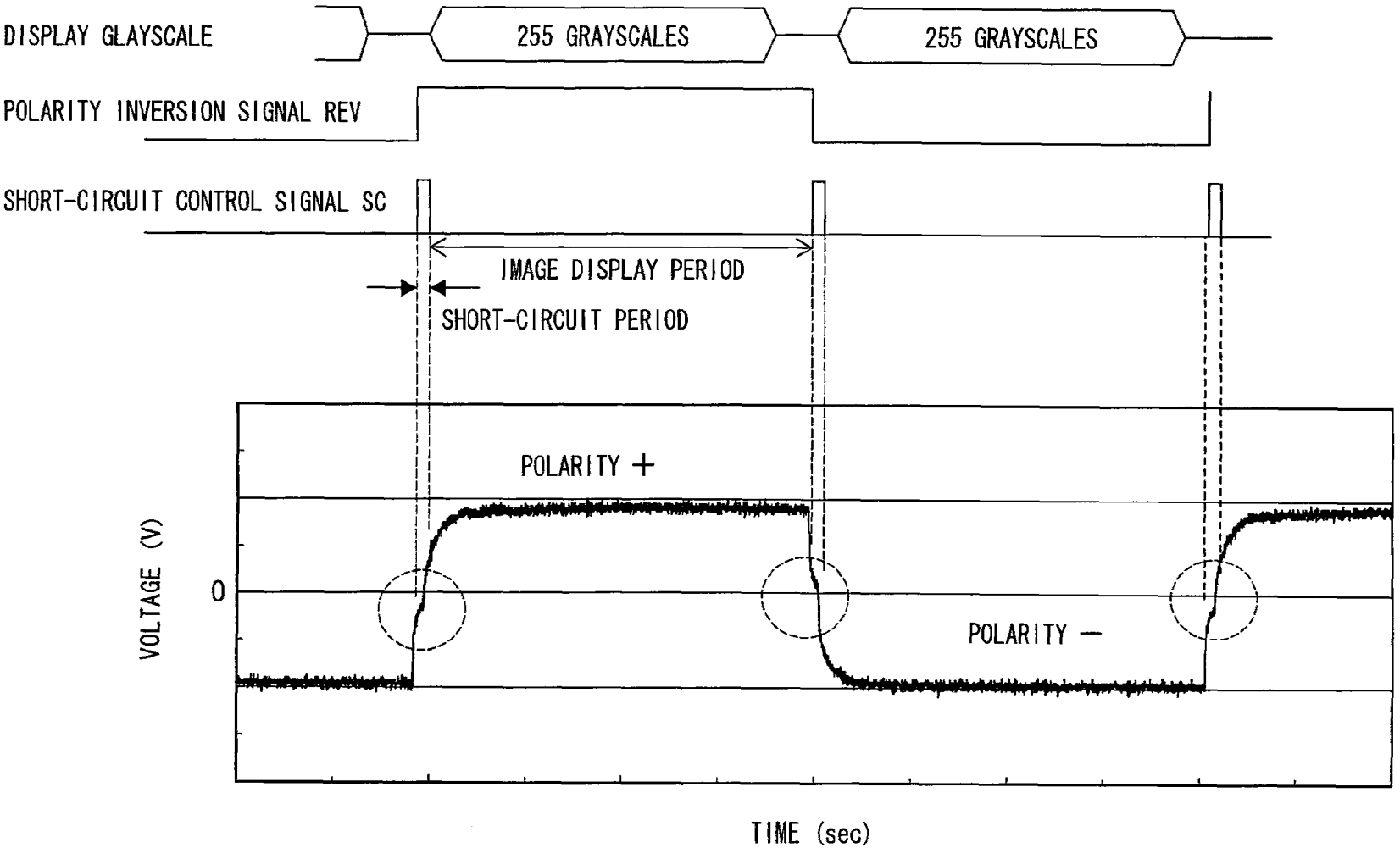
FIG. 8 is an waveform chart showing an example of a shape of potential on a data signal line of the display apparatus of the embodiment of the present invention.

FIG. 8 is an waveform diagram showing the electric potential of the data signal line in the short-circuit period and the image display period, which potential is measured by monitoring the electric potential on the output terminal of the source driver section 21 by an oscilloscope. In this example shown in the figure, the short-circuit period is provided while the polarity inversion is carried out, so that an inflection point appears in the shape of potential, during the polarity inversion. In the example shown in FIG. 8, the short-circuit period is provided each time the polarity of the grayscale display voltage is reversed. The length of the short-circuit period is set at about 1 μs. The length of the image display period is suitably set in accordance with the horizontal resolution, refresh rate, and the like. In the present embodiment, image display for two sub frames is carried out during the image display period.

When the short-circuit period finishes, the grayscale display voltage output from the output circuit 38 is supplied to each data signal line SL. As a result of this, the grayscale display voltage is applied to each pixel and hence the transmittance of the liquid crystal is updated. The image display scanning for first line is carried out in this way. As discussed above, in the present display apparatus, grayscale display voltages with inverse polarities are applied to horizontally-neighboring pixels in each sub frame. Therefore, in each sub frame, neighboring data signal lines receive grayscale display voltages with inverse polarities.

At the next output of the gate clock signal GCK from the controller LSI 18, the first gate driver is changed to be inactive. At this timing, the 564th line (gate signal line GL564) connected to the second gate driver is changed to be active and each source driver outputs grayscale display voltages for the pixels on the 564 line (GL564) in the second sub frame of the (N−1)-th frame.

As discussed above, in the present display apparatus, grayscale display voltages with inverse polarities are applied to vertically-neighboring pixels in each sub frame. Also, the polarity of the grayscale display voltage applied to each pixel is reversed in each frame. Therefore, the polarity of the grayscale display voltage which is applied to the first line (GL1) in the first sub frame of the N-th frame is identical with the polarity of the grayscale display voltage which is applied to the 564th line (GL564) in the second sub frame of the (N−1)-th frame.

For this reason, the controller LSI 18 does not change the short-circuit control signal SC to be active, in the image display scanning of the 564th line (GL564). In other words, in the image display scanning of the 564th line (GL564), there is no short-circuit period in which the voltages of the neighboring data signal lines are short-circuited so as to be neutralized.

Thereafter, when the controller LSI 18 outputs the next gate clock signal GCK, the 564th line (GL564) connected to the second gate driver is changed to be inactive, and the second line (GL2) of the first gate drive is changed to be active also at this timing. As in the case of the first line, each source driver receives the short-circuit control signal SC so that a short-circuit period is provided. After the short-circuit period, each source driver outputs grayscale display voltages for the pixels on the second line (GL2) in the first sub frame of the N-th frame.

Subsequently, in a similar manner, the gate signal lines GL are serially selected in the order of the 565th line, third line, 566th line, 4th line, and so on, and grayscale display voltages are written into them. As a result, it is possible to perform display scanning at a frame frequency twice as much as the input frame frequency at which first and second sub frames are generated (i.e. the display scanning is carried out at the double speed). For example, when the input frame frequency is 60 Hz, the display scanning is carried out at a frame frequency of 120 Hz.

Figure 1:
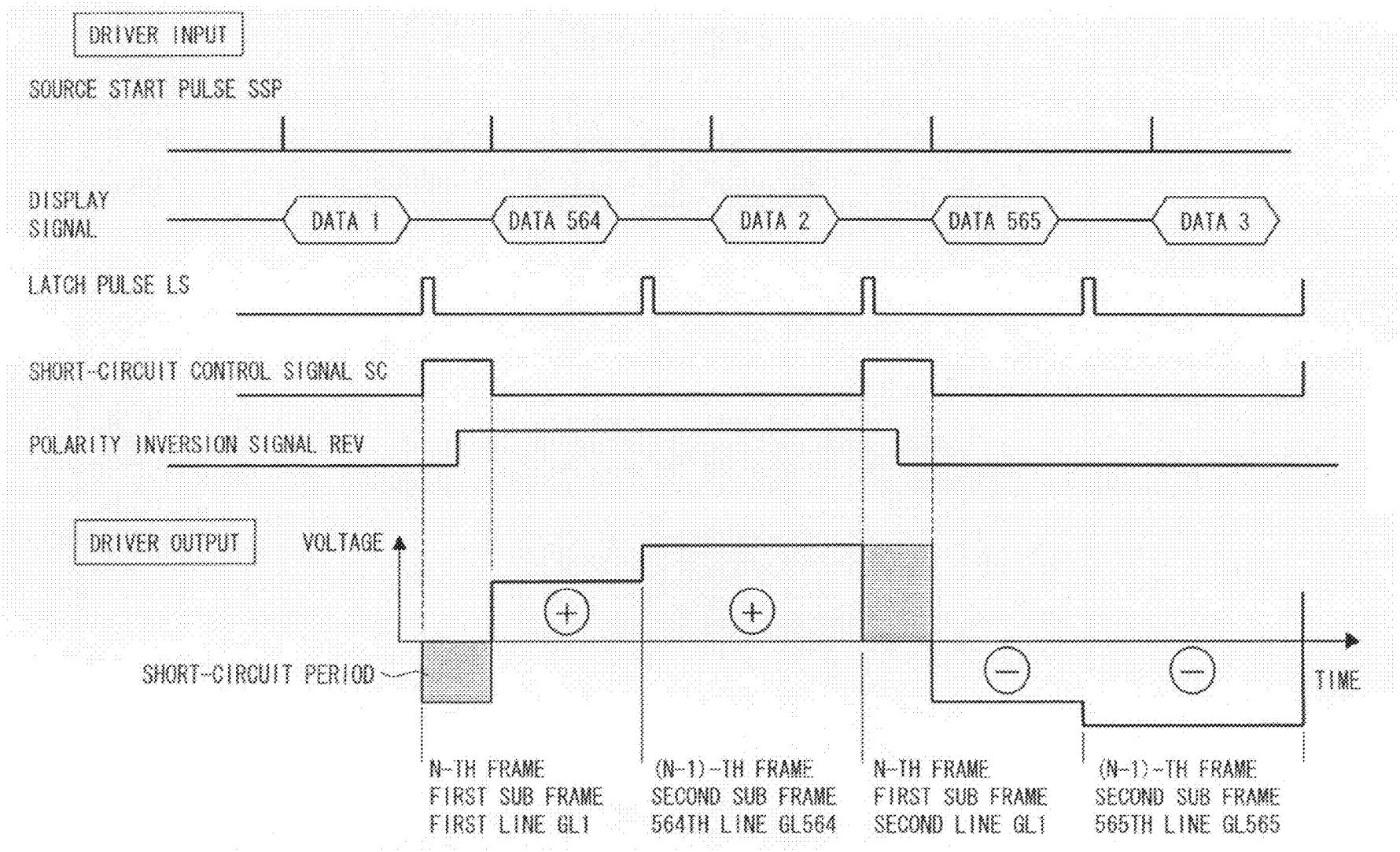
FIG. 1 illustrates an example of the relationship between (i) an input signal to a source driver section of a display apparatus of an embodiment of the present invention and (ii) an output signal from the source driver section.

FIG. 1 illustrates the relationship between an input signal to the source driver section 21 and an output signal from the source driver section 21, in the example above. As shown in the figure, in the present display apparatus, the polarity of the grayscale display voltage supplied to each data signal line is reversed each time 2 lines are scanned, and a short-circuit period is provided each time the polarity is reversed. In short, a short-circuit period is provided each time 2 gate signal lines are scanned.

As discussed above, in the present display apparatus, image display is carried out in such a way that one frame of an input image signal is time-divided into the first and second sub frames. Furthermore, the image display period of the first sub frame of the N-th frame is arranged to partly overlap at least the image display period of the second sub frame of the N-th frame and the image display period of the second sub frame of the (N−1)-th frame, so that the period during which the grayscale display voltages are written into all horizontal lines of the display screen in each sub frame is arranged to be equal to the image signal input period of one frame of an input image signal. Furthermore, in each sub frame, the grayscale display voltages charging the pixels which are horizontally or vertically neighbored are arranged to have inverse polarities. Furthermore, the polarity of the grayscale display voltage charging each pixel is reversed in each sub frame.

In this case, the polarity of the grayscale display voltage which is supplied from the source driver section 21 to each data signal line is reversed each time 2 gate signal lines are scanned. Since the frequency of the reversal of the polarity of the grayscale display voltage is reduced in this way, the power consumption is reduced.

In the example shown in FIG. 5, the scanning is repeated in the order of: (1) an odd-number-th gate signal line in the first sub frame of the N-th frame; (2) an even-number-th gate signal line in the second sub frame of the (N−1)-th frame; (3) an even-number-th gate signal line in the second sub frame of the N-th frame; and (4) an odd-number-th gate signal line in the second sub frame of the (N−1)-th frame. In this case, between (1) and (2) and between (3) and (4), the grayscale display voltage has the same polarity. On the other hand, between (2) and (3) and between (4) and (1), the grayscale display voltage has inverse polarities. As such, the polarity of the grayscale display voltage is reversed each time 2 gate signal lines are scanned.

Also, assume that the scanning is carried out in the following order: (a) an odd-number-th gate signal line in the first sub frame of the N-th frame; (b) an odd-number-th gate signal line in the second sub frame of the (N−1)-th frame; (c) an even-number-th gate signal line in the second sub frame of the N-th frame; and (d) an even-number-th gate signal line in the second sub frame of the (N−1)-th frame. The polarity of the grayscale display voltage is reversed between (a) and (b) and between (c) and (d), whereas the polarity is identical between (b) and (c) and between (d) and (a). As such, also in this case, the polarity of the grayscale display voltage supplied to each data signal line is reversed each time 2 gate signal lines are scanned.

In the present embodiment, the polarity of the grayscale display voltage supplied to each pixel is reversed in each sub frame. Alternatively, the polarity may be reversed in each frame. Also in this case, the polarity of the grayscale display voltage supplied to each data signal line is reversed each time 2 gate signal lines are scanned. In summary, the reversal of the polarity of the grayscale display voltage supplied to the data signal line, which is performed each time 2 gate signal lines are scanned, occurs not only in the case where the polarity of the grayscale display voltage supplied to each pixel is reversed in each sub frame but also in the case where the polarity of the grayscale display voltage supplied to each pixel is reversed in each frame.

In addition to the above, in the present display apparatus, a short-circuit period for short-circuiting neighboring data signal lines is provided each time 2 gate signal lines are scanned, i.e. each time the polarity of the grayscale display voltage supplied to each data signal line is reversed.

As a result of this, the neighboring data signal lines are charged with the grayscale display voltages with inverse polarities, and hence the voltages with which the neighboring data signal lines are charged are neutralized when the short-circuit switch is turned on, with the result that the data signal lines become to have the same electric potential. In other words, the potential of each line becomes close to an electric potential equivalent to a grayscale display voltage to be applied next. It is therefore possible to reduce the power consumption of the source driver section 21. Furthermore, the reduction in the power consumption makes it possible to restrain heat generation of the source driver section 21.

The short-circuit switch by which neighboring data signal lines are short-circuited is provided on the display module side (downstream) of the output circuit 38 of the source driver section 21. Since the data signal lines are short-circuited on the downstream of the output circuit 38, the heat generation of the source driver section 21 on account of short-circuit is restrained.

In the present display apparatus, a short-circuit period is provided each time 2 lines are scanned. For this reason, for pixels connected to the gate signal lines which are scanned without a short-circuit period, the charging period (image display period) of the grayscale display voltage is arranged to be longer. It is therefore possible to extend the charging period in comparison with the case where a short-circuit period is provided each time one gate signal line is scanned.

Figure 9:
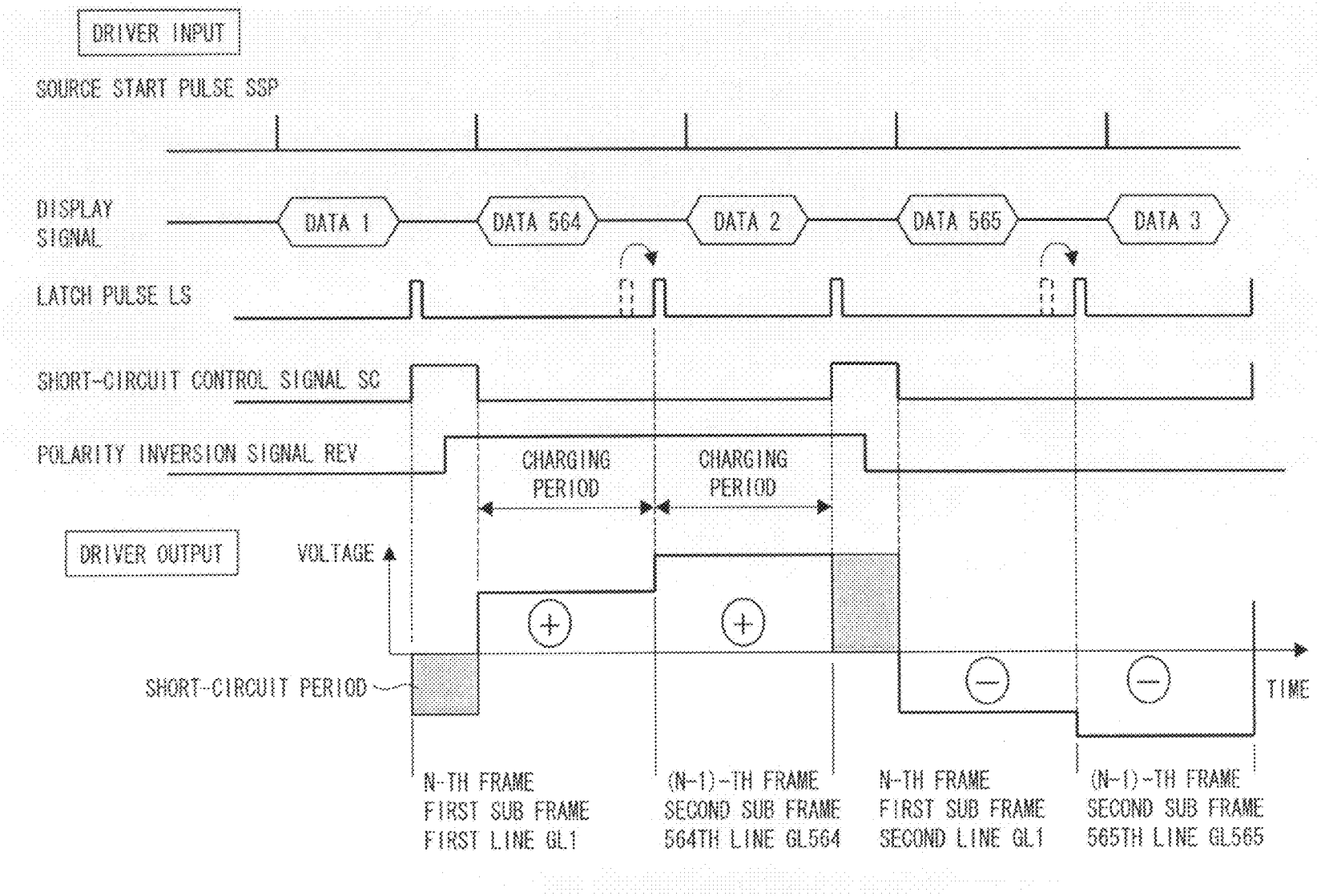
FIG. 9 illustrates the relationship between an input signal to the source driver section and an output signal from the source driver section, in the display apparatus of the embodiment of the present invention.

In the case above, the length of the charging period of a horizontal line (pixel connected to the gate signal line) which is scanned without a short-circuit period is different from the length of the charging period of a horizontal line with a short-circuit period. Alternatively, the lengths of the charging period may be identical or similar to each other. FIG. 9 illustrates the relationship between an input signal to the source driver section 21 and an output signal from the source driver section 21, in the aforesaid above.

As shown in the figure, the controller LSI 18 controls the timing (interval) of the latch pulse LS to be output to the source driver section 21 so that the length of the charging period in each sub frame is adjusted. Therefore, the lengths of the charging periods of sub frames can be equalized in such a way that, for a sub frame without a short-circuit period, the rise of the latch pulse LS is delayed by the half of the length of the short-circuit period.

In case where the lengths of the charging periods of the sub frames are equal as above, the length of the charging period of each sub frame is longer than the length of the charging period in the conventional case where a short-circuit period is provided each time one gate signal line is scanned.

In the present embodiment, the timing controller 13 of the controller LSI 18 generates the short-circuit control signal SC, and the operations of the disconnecting switches and the short-circuit switches are controlled based on the short-circuit control signal SC. Alternatively, for example, the source driver section 21 may be provided with means for generating the aforesaid short-circuit control signal SC based on the latch pulse LS output from the controller LSI (timing controller 13). In this case, since the controller LSI 18 is not required to generate the short-circuit control signal SC, the controller LSI is simplified.

Figure 10:
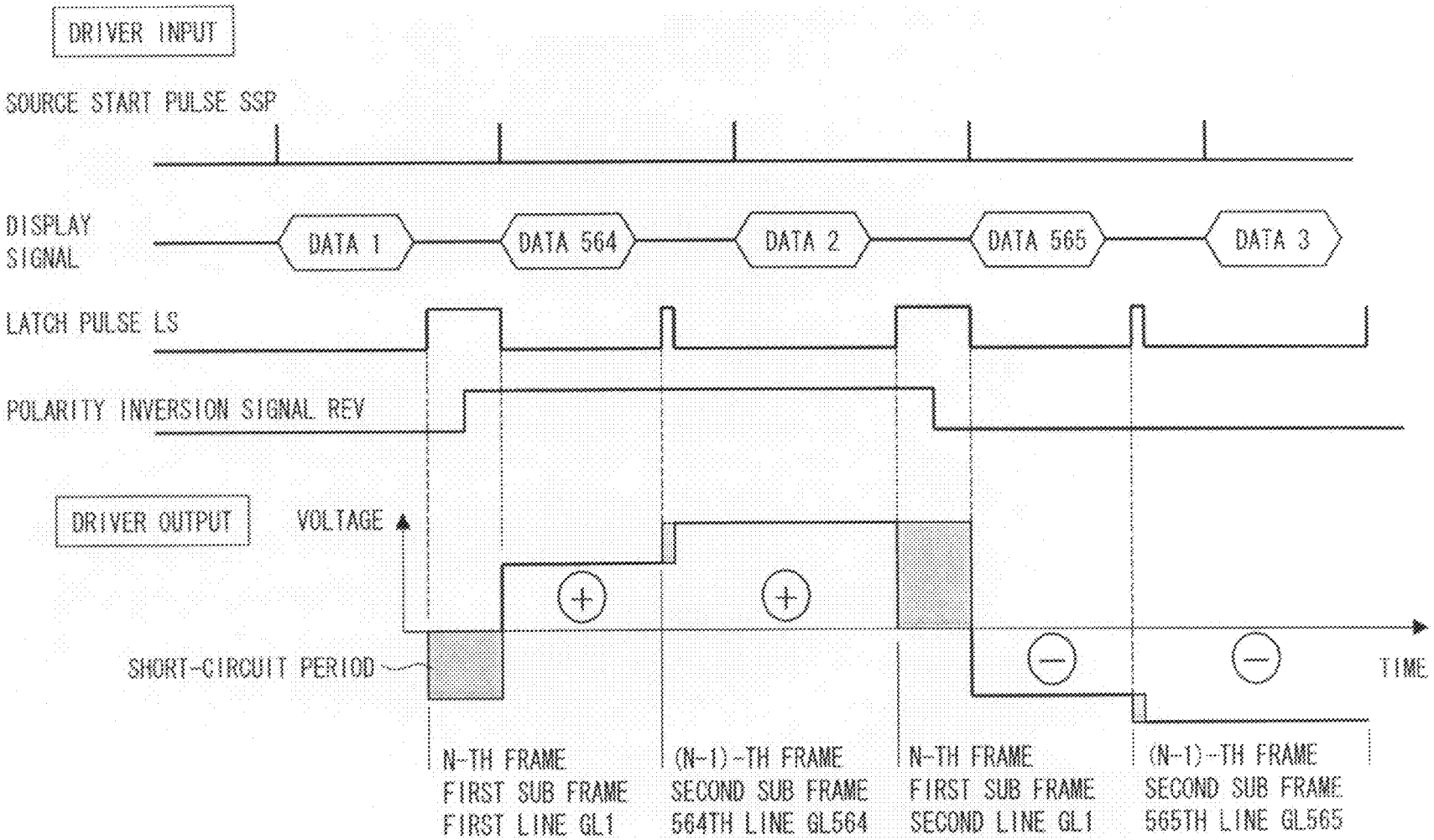
FIG. 10 relates to a case where the length of a short-circuit period is controlled using a latch pulse and illustrates an example of the relationship between an input signal to the source driver section and an output signal from the source driver section, in the display apparatus of the embodiment of the present invention.

Alternatively, the operations of the disconnecting switches and the short-circuit switches may be controlled directly using the latch pulse LS. In this case, for example, each disconnecting switch is turned off and each short-circuit switch is turned on when the latch pulse LS indicates active (i.e. is at high level). FIG. 10 illustrates the relationship between an input signal to the source driver section 21 and an output signal from the source driver section 21 in this case.

The latch pulse LS is used not only for the control of the short-circuit period but also for the control of the timing to output the grayscale display voltage from the source driver section 21. Therefore, it is not possible to completely eliminate a period in which the latch pulse LS is active, even for a sub frame which does not require a short-circuit period (i.e. a sub frame during which the polarity of the grayscale display voltage supplied to the data signal line is not reversed). For this reason, as shown in FIG. 10, when the control of the short-circuit period is carried out using the latch pulse LS, the active period of the latch pulse LS in case where the polarity of the grayscale display voltage is reversed is arranged to have a length (e.g. about 1 μs) sufficient to neutralize the electric potentials of neighboring data signal lines, whereas the active period of the latch pulse LS in case where the polarity is not reversed is arranged to be as short as possible on condition that the control of the timing to output the grayscale display voltage from the source driver section 21 is properly carried out.

In this way, the charging period of the grayscale display voltage is elongated in comparison with the conventional case where a short-circuit period is provided each time one gate signal line is scanned.

Figure 11:
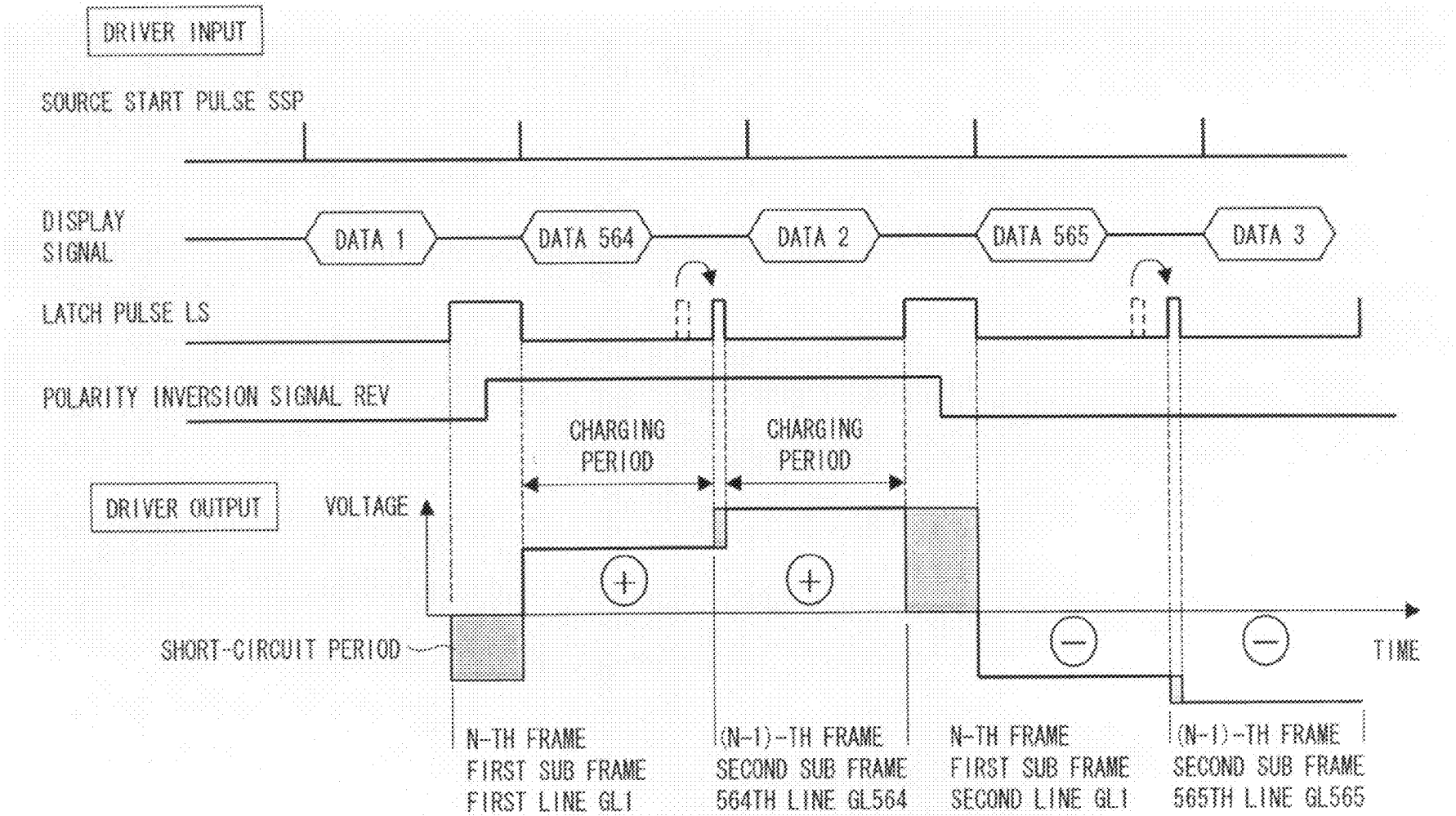
FIG. 11 relates to a case where the length of a short-circuit period is controlled using a latch pulse and illustrates an example of the relationship between an input signal to the source driver section and an output signal from the source driver section, in the display apparatus of the embodiment of the present invention.

Also in this case, as shown in FIG. 11, the charging periods of respective sub frames can be arranged to have the same length by controlling the timing at which the latch pulse LS is changed to be active.

The present embodiment has chiefly explained the case where one frame is time-divided into two sub frames. While not limited to this, one frame may be divided into n (n is an integer not less than 2) sub frames.

In this case, for example, in case where the polarity of the grayscale display voltage with which each pixel is charged is reversed in each sub frame, preferably odd-number-th gate signal lines and even-number-th gate signal lines are alternately scanned in such a manner that, after the grayscale display voltage of the first sub frame of the N-th frame is applied to the first gate signal line GL1, the grayscale display voltage of the n-th sub frame of the (N−1)-th frame is applied to an even-number-th gate signal line, and then the grayscale display voltage of the (n−1)-th sub frame of the (N−1)-th frame is applied to an odd-number-th gate signal line. In other words, preferably, the polarity of the grayscale display voltage with which each pixel is charged is reversed in each sub frame, and when image display periods of different sub frames are arranged to overlap one another, odd-number-th gate signal lines and even-number-th gate signal lines are alternately scanned in such a way that the polarity of the grayscale display voltage supplied to each data signal line is reversed each time a plural number of gate signal lines are scanned.

As a result of this, the polarity of the grayscale display voltage supplied to each data signal line is reversed each time the scanning is carried out for the number identical with the number of sub frames that the image display periods overlap. Since the frequency of the reversal of the polarity of the grayscale display voltage supplied to each data signal line is reduced in this way, the power consumption is reduced. Furthermore, the total length of the charging periods of the respective sub frames is extended by providing a short-circuit period each time the polarity of the grayscale display voltage supplied to each data signal line is reversed. It is noted that the charging periods of all sub frames can be extended by equalizing the lengths of the charging periods of the respective sub frames.

In case where the polarity of the grayscale display voltage with which each pixel is charged is reversed in each frame, preferably plural odd-number-th gate signal lines (or even-number-th gate signal lines) are successively scanned in such a manner that, after the grayscale display voltage of the first sub frame of the N-th frame is supplied to the first gate signal line GL1, the grayscale display voltage of the n-th sub frame of the (N−1)-th frame is applied to an odd-number-th gate signal line, and then the grayscale display voltage of the (n−1)-th sub frame of the (N−1)-th frame is applied to another odd-number-th gate signal line. In other words, in case where the polarity of the grayscale display voltage with which each pixel is charged is reversed in each frame and the image display periods of different sub frames are arranged to overlap one another, preferably plural odd-number-th gate signal lines (or even-number-th gate signal lines) are successively scanned so that the polarity of the grayscale display voltage supplied to each data signal line is reversed each time plural gate signal lines are scanned.

More specifically, when the polarity reversal is represented in the form of (polarity of first sub frame of first frame; polarity of second sub frame of first frame; polarity of first sub frame of second frame; polarity of second sub frame of second frame; . . . ; . . . ), the polarity of the grayscale display voltage is reversed in each frame in such a manner that (++, −−) when n=2, (+++, −−−) when n=3, and (++++, −−−−) when n=4. In this case, the polarity of the voltage for grayscale image display, which is supplied to each pixel, is reversed only once in two frames.

In case of n=4, for example, plural odd-number-th gate signal lines (or even-number-th gate signal lines) are successively scanned in such a manner that the scanning of the first sub frame of the N-th frame is carried out for an odd-number-th gate signal line, the scanning of the fourth sub frame of the (N−1)-th frame is carried out for an odd-number-th gate signal line, the scanning of the third sub frame of the (N−1)-th frame is carried out for an odd-number-th gate signal line, the scanning of the first sub frame of the N-th frame is carried out for an even-number-th gate signal line, and the scanning of the fourth sub frame of the (N−1)-th frame is carried out for an even-number-th gate signal line. In this way, the polarity of the grayscale display voltage supplied to each data signal line is reversed each time plural gate signal lines are scanned.

Therefore, since the frequency of the reversal of the polarity of the grayscale display voltage supplied to each data signal line is reduced, the power consumption is reduced. Furthermore, the total length of the charging periods of the respective sub frames is extended by providing a short-circuit period each time the polarity of the grayscale display voltage is reversed. It is noted that the charging periods of all sub frames can be extended by equalizing the lengths of the charging periods of the respective sub frames.

The polarity of the grayscale display voltage supplied to each pixel is not necessarily reversed in each sub frame or in each frame. For example, the polarity may be reversed in plural sub frames, e.g. (+−, −+) when n=2, (++−, −−+) or (+−−, −++) when n=3, and (+−−−, −+++), (++−−, −−++), or (+++−, −−−+) when n=4.

Also in these cases, the order of scanning of the gate signal lines is preferably arranged so that the polarity of the grayscale display voltage supplied to each data signal line is reversed each time plural gate signal lines are scanned. This makes it possible to reduce the frequency of the reversal of the polarity of the grayscale display voltage supplied to each data signal line, and hence the power consumption is reduced. Furthermore, the total length of the charging periods of the respective sub frames is extended by providing a short-circuit period each time the polarity of the grayscale display voltage is reversed. It is noted that the charging periods of all sub frames can be extended by equalizing the lengths of the charging periods of the respective sub frames.

When the control of the short-circuit period is carried out using the latch pulse LS, the active period of the latch pulse LS in case where the polarity of the grayscale display voltage is reversed is arranged to have a length sufficient for the short-circuit period, whereas the active period of the latch pulse LS in case where the polarity is not reversed is arranged to be as short as possible on condition that the control of the timing to output the grayscale display voltage is properly carried out.

This makes it possible to extend the total length of the charging periods of the sub frames, in comparison with the conventional arrangement. Furthermore, also in this case, the charging periods of all sub frames can be extended by equalizing the lengths of the charging periods of the respective sub frames, in comparison with the conventional arrangement.

In the present display apparatus, since the image display period of the first sub frame of the N-th frame (N is an integer not less than 2) is arranged to partly overlap at least the image display period of the second sub frame of the N-th frame and the image display period of the n-th sub frame (n is an integer not less than 2) of the (N−1)-th frame, it is possible to reduce the capacity of the frame memory 11 in which an image signal is stored for generating a display signal of a sub frame.

That is to say, the image signal must be stored in a memory (e.g. frame memory) until the display signal of the last-stage sub frame is generated. Therefore, when the image display operations of the respective sub frames are serially carried out in such a way that the image display operation of the second sub frame is carried out after the image display operation of the first sub frame is carried out, the memory is required to store all of the image signal for one frame, until the display signal of the n-th sub frame which is the last sub frame.

On the other hand, when the image display operations of plural sub frames are concurrently carried out as in the arrangement above, in a memory area storing an image signal for a horizontal line, from which signal the display signal of the sub frame (n-th sub frame) of the last stage has been generated, it is possible to write an input image signal of another horizontal line. It is therefore possible to share a memory area between horizontal lines.

The following specifically explains the above with reference to FIG. 5. In the present display apparatus, an image signal of the first line of the N-th frame, which has been input to the line memory 16 and read out from the line memory 16 at a double speed, is output to the display module 19 via the grayscale conversion circuit 15 for each sub frame in order to carry out the first sub frame display, and is concurrently written into the frame memory 11 for the sake of the second sub frame display. The image signal must be stored in the frame memory 11 until the image display of the first line of the second sub frame of the N-th frame is carried out.

In the meanwhile, what is read out from the frame memory 11 before the writing of the image signal of the first line of the N-th frame is an image signal of the 563rd line of the (N−1)-th frame. This image signal data is used for the second sub frame of the (N−1)-th frame, and is unnecessary after being read out. Therefore, the image signal of the first line of the N-th frame can be overwritten onto the address where the image signal of the 563rd line of the (N−1)-th frame has been stored. In a similar manner, the image signal of the second line of the N-th frame can be overwritten onto the address where the image signal of the 564th line of the (N−1)-th frame has been stored.

Figure 12:
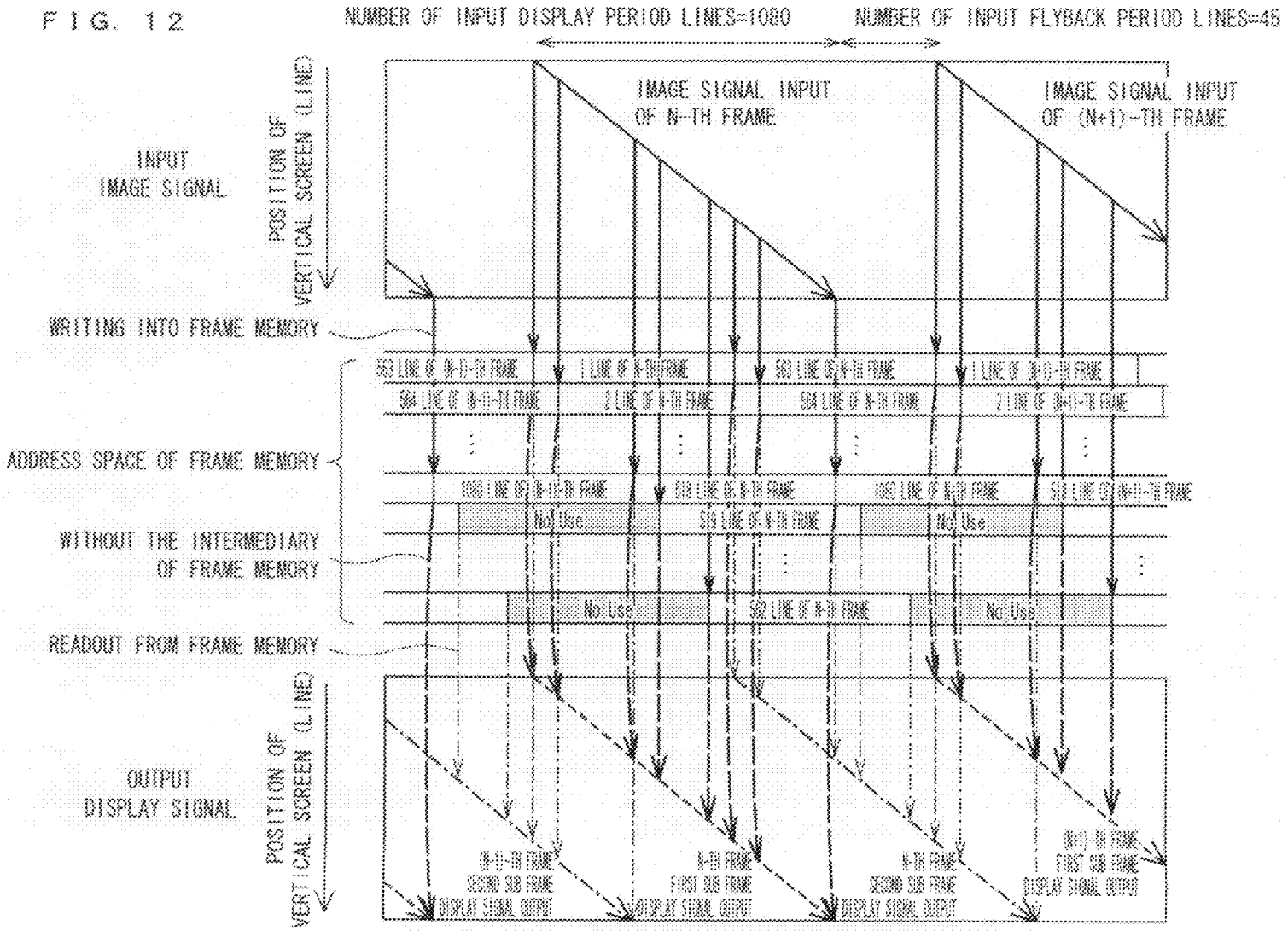
FIG. 12 illustrates the timings, the writing into a frame memory, and the readout of the input image signal and the output display signal, in the display apparatus of the embodiment of the present invention.

FIG. 12 shows the timings of an image signal to be input (input image signal) and a display signal to be output (output display signal), and the states of writing and readout into/from the frame memory 11. The oblique arrows on the upper part of the figure indicate input image signals, whereas the oblique arrows on the lower part of the figure indicate output display signals in the first and second sub frames. The bands in the middle indicate which areas of the frame memory 11 are used. For example, the figure shows that the area where the signal of the 563rd line of the (N−1)-th frame has been kept is serially overwritten by the signal of the first line of the N-th frame and the signal of the 563rd line of the N-th frame.

The dotted arrows extending from the input image signals to the frame memory 11 indicate the writing into the frame memory 11, the chain lines extending from the frame memory 11 to the output display signals of the second sub frame indicate the readout from the frame memory, and the narrow arrows extending from the input image signals to the output display signals of the first sub frame indicate the flow of signals without the intermediary of the frame memory 11.

In the present display apparatus, the lengths of the first and second sub frames are arranged to be equal. In other words, the period from the writing of the grayscale display voltages of a sub frame into all horizontal lines to the writing of the grayscale display voltage of the next sub frame is identical between the first and second sub frames. On this account, the delay from the start of the first line display of the first sub frame to the start of the first line display of the second sub frame is equivalent to (1080+45)/2=562.5 lines. In this case, as shown in FIG. 12, the first to 518th lines and the 563rd to 1080th lines share the areas of the frame memory where the image signals are kept, and hence the frame memory areas equivalent to 562 lines are required. In other words, in case where the lengths of the first and second sub frames are identical, the required frame memory capacity is calculated as follows: (the number of input display period lines+the number of input flyback period lines)/about 2≈0.5 frame.

In this way, the memory controller 12 is arranged so that, when the display signal of the sub frame of the last stage is generated for a line, the area of the memory 11, where the image signal of that line has been stored, is overwritten by an input image signal of another line.

As discussed above, the required memory capacity is determined in accordance with the number of sub frames. Although being slightly varied depending on the length of the flyback period, the required memory capacity is equivalent to about (N−1)/N frames when the number of sub frames is N, is equivalent to about ½ of one frame when the number of sub frames is 2, and is equivalent to about ⅔ of one frame when the number of sub frames is 3.

Furthermore, since the image display operation of the sub frame of the first stage for all pixels of the display screen is carried out with a minimum delay from the input of the input image signal to each pixel, the image display based on the image signal is carried out before one frame period elapses from the input of the image signal. Therefore, a time lag between the input of the image signal and the actual image display is negligible. For this reason, there is no gap between a displayed image and sound in a case of a television receiver or the like, and hence a circuit for delaying sound or the like is unnecessary. Also, when the present display apparatus is used as a display apparatus for devices such as PC and game console, which are required to promptly update the screen in response to an input, it is possible to perform image display in which an influence of a time lag on operations is small.

It is possible to arrange the time lag to be negligible when the image display operation of the sub frame of the first stage for all pixels of the display screen is performed within a period which is less than half as much as, preferably less than 20%, of the frame period of the input image signal from the input of the image signal to each pixel.

Furthermore, in the present display apparatus, while the display signal of the second sub frame is generated by reading out the image signal from the frame memory 11, the display signal of the first sub frame of the first stage is generated by temporarily storing the input image signal in the line memory 16, without the intermediary of the frame memory 11. It is therefore possible to reduce the frequency of access (writing and readout) to the frame memory 11, and hence the memory band width of the frame memory 11 is reduced.

In the conventional display apparatus performing sub frame display, it is necessary to (twice) read out the image signal of the N-th frame which has been written in, concurrently with the writing of the image signal of the (N+1)-th frame which is subsequent to the N-th frame. Therefore, the memory capacity of the frame memory in which an input image signal is stored must be equivalent to 2 screens (2 frames) for storing and readout, respectively.

Furthermore, in the conventional display apparatus performing sub frame display, both of the display signals of the first and second sub frames are generated by reading out an image signal having been stored in the frame memory. On this account, into/from the frame memory, the writing of input one screen and the double-speed readout of output 2 screens must be concurrently carried out, and hence the required memory band width is large. More specifically, provided that the transmission frequency (dot clock frequency) of an input image signal is F(Hz) and the number of data bits for one pixel is D, the required memory band width for concurrently performing the writing of input one screen and the double-speed readout of output 2 screens is represented as FD+(2F)D*2=5FD(bps).

On the other hand, in the present display apparatus, only writing of input one screen and readout of output one screen are concurrently performed with respect to the frame memory 11. Therefore, provided that the transmission frequency (dot clock frequency) of an input image signal is F(Hz) and the number of data bits for one pixel is D, the required memory band width is represented as FD+FD=2FD(bps). In this way, the required memory band width is significantly smaller than that of the conventional driving method (5FD). As the memory band width increases, it is required to increase either the clock frequency for memory access or the number of terminals of the memory, and hence the power consumption and the cost increase. Since the memory band width in the present display apparatus is small, such increase in the power consumption and the cost is prevented.

In the present display apparatus, neighboring data signal lines are short-circuited in such a way that the output circuit 38 of the source driver section 21 is disconnected from the data signal line by the disconnecting switch. When the data signal lines are short-circuited while the output circuit 38 is connected to the data signal line, the output of the D/A conversion circuit 36 is short-circuited and hence over-current may occur or the output may become unstable. Therefore, as with the present display apparatus, preferably the disconnection switch is provided between the output circuit 38 of the source driver section 21 and the data signal line, and the disconnecting switch is turned off when neighboring data signal lines are short-circuited.

The present display apparatus may be arranged to support plural types (e.g. two types; 60 Hz and 50 Hz) of input frame frequencies. In this case, the control apparatus 10 performs control so as to equalize the display period of the first sub frame and the display period of the second sub frame, by changing the time from the input of the image signal to each horizontal line to the display operation for the first sub frame, in accordance with a change in the input frame frequency (i.e. a change in the length of one frame period).

In this way, even if the length of one frame period is changed on account of a change of the input frame frequency, the temporal ratio between sub frame periods in one frame period is not changed. Therefore, a time integral amount of display brightness of each sub frame is not changed in one frame period. It is therefore possible to use the same grayscale conversion value for each sub frame, even if a frame frequency is different, and hence the cost for the grayscale conversion means is restrained.

Depending on the response characteristics of the display module, there is a case where the lengths of sub frames are not required to be identical to enhance the improvement in motion blur. In such cases, grayscale conversion values corresponding to input frame frequencies are prepared even if cost increase is involved. Therefore the present invention is not limited to a case where sub frame periods have the same lengths.

Depending on an external input apparatus connected to the present display apparatus, such as a tuner section of a TV receiver and a PC, the length of one input frame period may be slightly unstable. For example, the input frame total line number may be randomly changed in the range of T−3 and T+3, as compared to the standard total line number T. As for such a variation in one input frame period, if the length of each frame period is always fine-tuned in accordance with the input one frame total line number, the cost of the control circuit increases. For this reason, for such a variation in the input one frame period, a time from the input of the image signal to each horizontal line to the display operation of the horizontal lines in the second sub frame is fixed with reference to the standard total line number T.

For example, in case where the control apparatus 10 can deal with two types of input frame frequencies, 60 Hz and 50 Hz, two standard input one frame total lines, T1 for 60 Hz and T2 for 50 Hz, are prepared.

Now, the following will describe the gate driver section 23 which makes it possible to perform the driving discussed above.

The gate driver section 23 has a clock skip mode in which, after g (which is an integer not less than 2, g=2 in the explanation above) gate clocks have been counted after the gate clock at which the first gate signal line GL1 is changed to be active, the second gate signal line GL2 of the subsequent stage is changed to be active.

Therefore, by using this clock skip mode, it is possible to perform the driving such that, as shown in FIG. 5, the second gate signal line GL2 is changed to be active after two gate clocks have been counted after the gate clock at which the first gate signal line GL1 is changed to be active.

The gate driver section 23 is constituted by first to third gate drivers which are cascaded. With this arrangement, as indicated by the timing to output the gate start pulse GSP from the first gate driver to the second gate driver, which is shown in FIG. 5, the first gate driver causes the 360th gate signal line GL360 which is the last gate signal line GL to be active, then causes the gate signal line GL360 to be inactive at the next gate clock, and outputs the gate start pulse GSP to the second gate driver, at the gate clock directly subsequent to the gate clock at which the gate signal line GL 360 was changed to be inactive.

With this arrangement, the gate signal line GL361, which is the first stage of the second gate driver, and the subsequent signal lines are changed to be active at the timing of the gate clock directly subsequent to the gate clock at which the first gate signal line GL360 was changed to be inactive. Therefore, in this gate driver clock skip mode, gate signal line control is serially performed as if the three connected gate drivers function as a single gate driver.

To deal with image display without sub frame division, each of the gate drivers constituting the gate driver section 23 is preferably arranged to be switchable between the aforesaid clock skip mode and the normal mode in which the second gate signal line GL2 is changed to be active at the gate clock subsequent to the gate clock at which the first gate signal line GL1 is changed to be active.

In each of the gate drivers constituting the gate driver section 23, g is preferably changeable. That is to say, g is determined in accordance with the number of sub frames. For example, g=2 if the number of sub frames is 2, and g=3 if the number of sub frames is 3. When g is switchable in this way, it is possible to deal with image displays with different numbers of sub frames.

Such a change in g may be performed by the user using a switch, in accordance with a display target image. Alternatively, in a case of a display apparatus in which the number of sub frames is set in accordance with a display target image, g may be switched in such a manner that the type of an input image signal is determined, the number of sub frames at the time of division of the input image signal is specified, and the switching is performed in accordance with the result of the specifying.

Now the following will describe how plural sub frame display signals are generated from an image signal in the grayscale conversion circuit 15 for each sub frame in the control apparatus 10.

Although not particularly illustrated, the grayscale conversion circuit 15 for each sub frame includes a first LUT (look-up table) which is a correspondence table for converting an image signal into a display signal of the first sub frame and a second LUT which is a correspondence table for converting an image signal into a display signal of the second sub frame.

The values stored in the first and second LUTs are arranged as follows. It is noted that, in the case below, the display signal of the second sub frame has higher brightness than the display signal of the first sub frame. Alternatively, the brightness may be conversely set.

When the grayscale of the image signal is not higher than a predetermined threshold (i.e. identical with or less than the brightness indicated by the threshold), the value of the display signal of the first sub frame falls under the range for dark display, and the value of the display signal of the second sub frame is set in accordance with the value of the display signal of the first sub frame and the grayscale value of the image signal. The range for dark display is not higher than a predetermined grayscale for dark display. When the grayscale for dark display is the minimum display, the range indicates a grayscale (black) corresponding to the minimum brightness.

On the other hand, when the grayscale of the image signal indicates brightness higher than a predetermined threshold (i.e. brightness higher than the brightness indicated by the threshold), the value of the display signal of the second sub frame is set at a value falling within the range for bright display, whereas the value of the display signal of the first sub frame is set at a value corresponding to the value of the display signal of the second sub frame and the grayscale of the image signal. The range for bright display is not lower than a predetermined grayscale predetermined for bright display. When the grayscale for bright display indicates the maximum brightness, the range is at the grayscale (white) indicating the maximum brightness.

Figure 13:
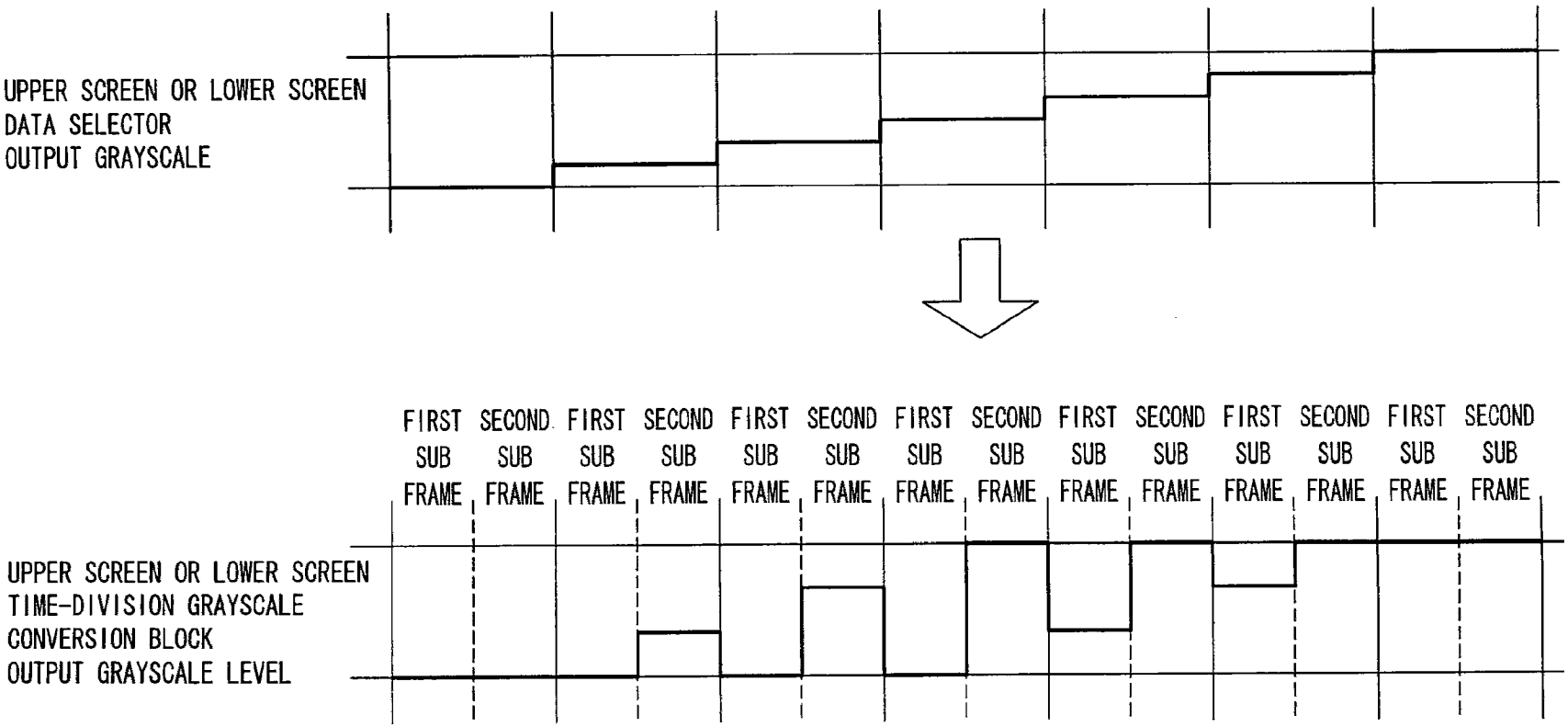
FIG. 13 illustrates how the grayscale levels of respective sub frames are set in the display apparatus of the embodiment of the present invention.

FIG. 13 shows an example where conversion to display grayscales of the first and second sub frames is carried out in accordance with the grayscale of the image signal supplied to the grayscale conversion circuit 15 for each sub frame.

When the grayscale level of the input image signal is high, the grayscale level of the input image signal is distributed to both sub frames. In doing so, a difference between the brightness integral value when the input grayscale level is maximum and the brightness integral value when the input grayscale level is minimum is maximized. Furthermore, in order to achieve impulse-type display while avoiding decrease in the contrast ratio, a highest possible output grayscale level is distributed to the second sub frame whereas a lowest possible output grayscale level is distributed to the first sub frame.

As a result, in case where an image signal for a pixel in a frame indicates a grayscale not higher than the aforesaid threshold, i.e. in the low brightness range, the degree of the brightness of the pixel in the frame is predominantly determined by the degree of the value of the display signal in the second sub frame.

Therefore, it is possible to arrange the display state of the pixel to be dark display, at least in the first sub frame of the aforesaid frame. As a result of this, when the grayscale of an image signal in a frame indicates a grayscale in the low brightness range, the light emission state of the pixel in the frame is brought close to the impulse-type light emission such as light emission by a CRT (Cathode-Ray Tube), and hence the quality of moving images displayed by the pixel array 20 is improved.

When one frame is time-divided into n sub frames, n LUTs are provided, the display signal of each sub frame is arranged to indicate brightness higher than that of the directly preceding sub frame and a difference in the brightness is maximized when successive sub frames are different in brightness. Alternatively, the display signal of each sub frame is arranged to indicate brightness higher than that of the directly subsequent sub frame and a difference in the brightness is maximized when successive sub frames are different in brightness.

Figure 14:
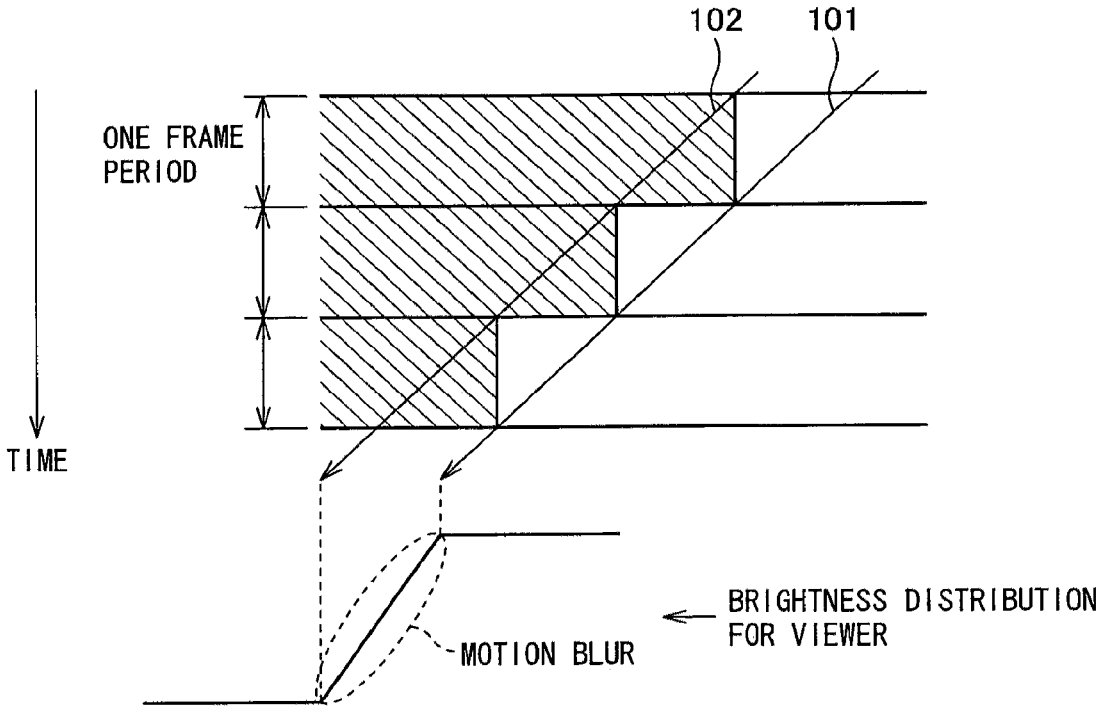
FIG. 14(*a*) explains why motion blur is restrained in the display apparatus of the embodiment of the present invention, and shows how the border between two areas with different brightness moves while hold-type display is carried out, assuming that the vertical axis indicates time whereas the horizontal axis indicates position.
Figure 14:
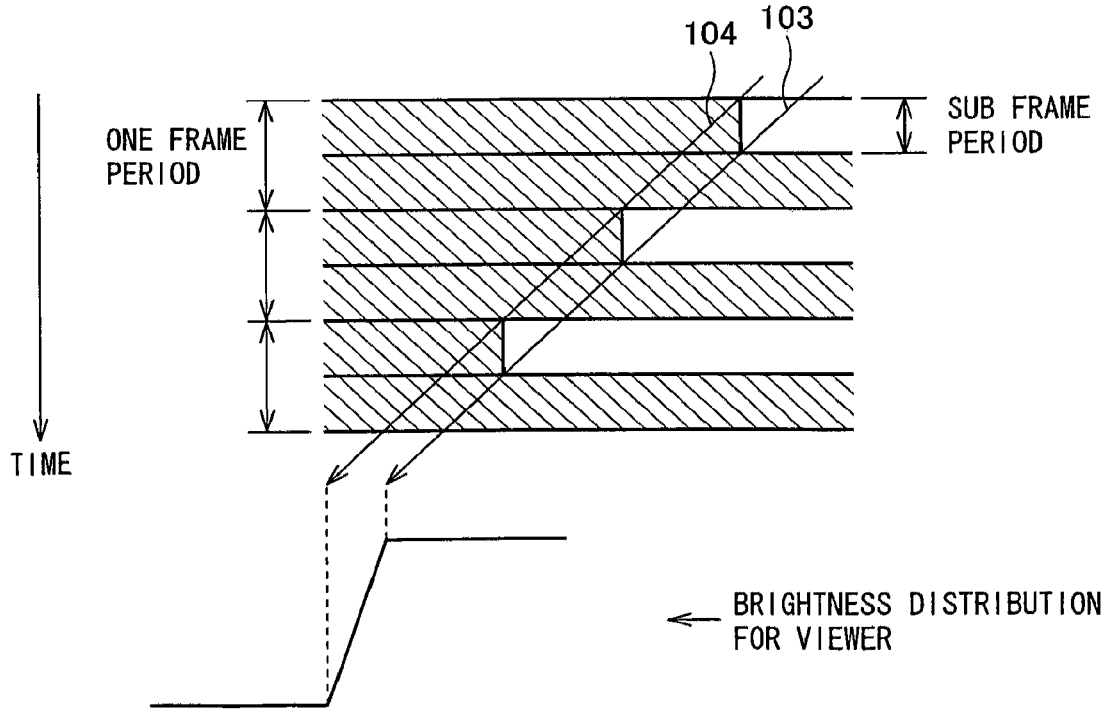
Figure 15:
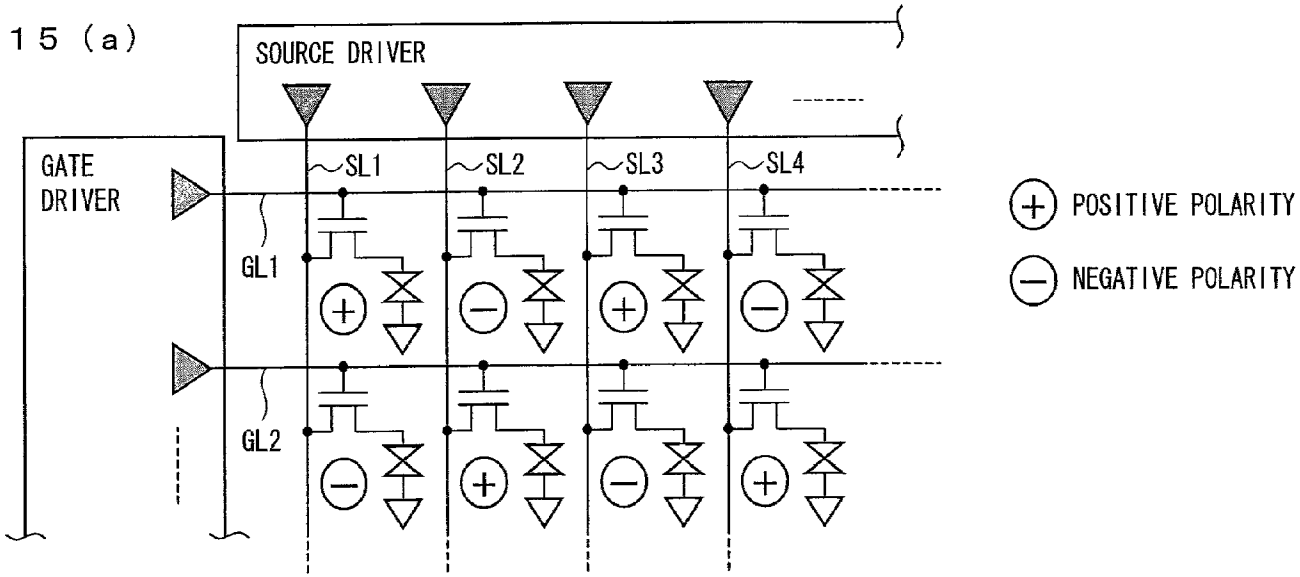
FIG. 15(*a*) illustrates the polarities of grayscale display voltages applied to respective pixels of a conventional liquid crystal display apparatus performing dot inversion driving.
Figure 15:
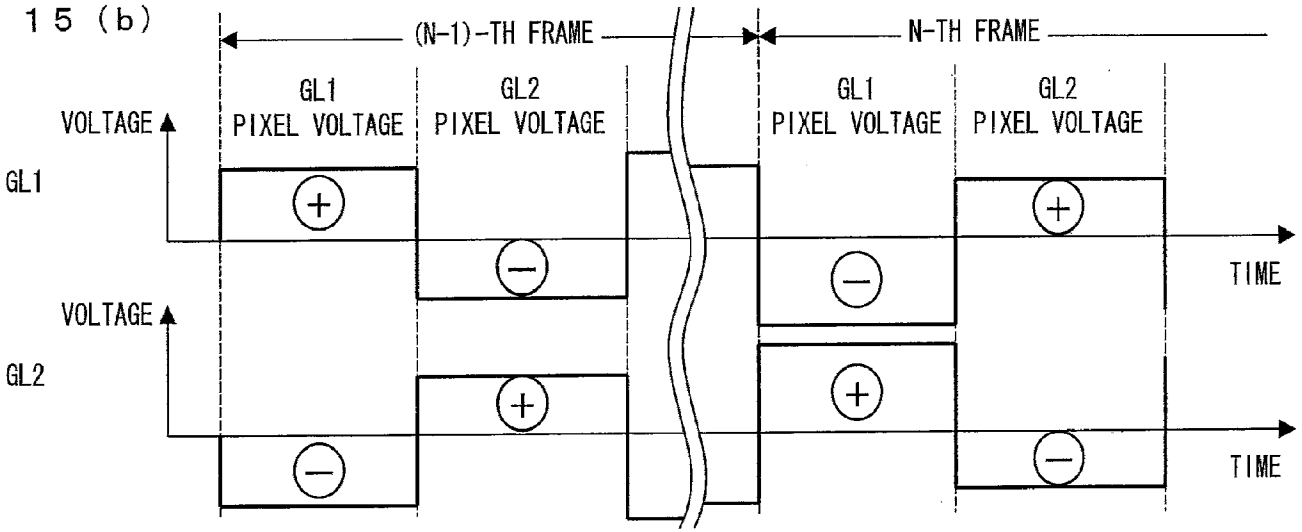

The following briefly explains why impulse-type driving restrains motion blur, with reference to FIG. 14(*a*) and FIG. 14(*b*).

FIG. 14(*a*) illustrates how the border between two areas which are different in brightness moves when hold-type display is carried out, assuming that the vertical axis indicates time whereas the horizontal axis indicates position. Similarly, FIG. 14(*b*) illustrates how the border between two areas which are different in brightness moves when impulse-type driving is carried out. In FIG. 14(*b*) showing the impulse-type driving, two sub frames are provided and the ratio therebetween is 1:1.

In case where the border moves in this manner, the line of sight of the viewer moves in line with the movement of the border. In FIG. 14(*a*), the lines of sight of the viewer are indicated by arrows 101 and 102. Around the aforesaid border, the distribution of brightness for the viewer is a time integral of the display brightness along the movement of the sight line. Therefore, in FIG. 14(*a*), the brightness in the area to the left of the arrow 102 is perceived to be identical with the brightness of the area to the left of the border, whereas the brightness in the area to the right of the arrow 101 is perceived to be identical with the brightness of the area to the right of the border. On the other hand, in the area between the arrows 101 and 102, the brightness is perceived so as to slightly increase. This area is perceived as motion blur.

Similarly, in the case of impulse-type driving shown in FIG. 14(*b*), in the distribution of brightness for the viewer around the border, motion blur occurs in the area between the arrows 103 and 104. However, since the gradient is steeper than the case of hold-type driving shown in FIG. 14(*a*), it is observed that motion blur is restrained.

As a result, when the image signal for a pixel in a frame indicates a grayscale of not higher than the aforesaid threshold, i.e. in a low brightness range, the degree of the brightness of that pixel in the frame is mainly determined by the degree of the value of the display signal of the second sub frame. On this account, the display state of the pixel is arranged to be dark display, at least in the first sub frame in the frame. Therefore, when the grayscale of an image signal in a frame is in a low brightness range, the light emission state of the pixel in the frame is brought close to impulse-type light emission such as that of a CRT (Cathode-Ray Tube), and hence the quality of moving images on the pixel array 20 is improved.

When the grayscale of an image signal to a pixel in a frame indicates a grayscale higher than the aforesaid threshold, i.e. in a high brightness range, the degree of the brightness of the pixel in the frame is mainly determined by the degree of the grayscale level of the display signal of the first sub frame. Therefore, in comparison with the arrangement in which the brightness is substantially evenly distributed to the first sub frame and the second sub frame, it is possible to greatly differentiate the brightness of the pixel in the first-half sub frame from the brightness of the pixel in the second-half sub frame. As a result, when the grayscale of an image signal in a frame indicates a high brightness range, the light emission state of the pixel in the frame is brought close to impulse-type light emission in most cases, and hence the quality of moving images on the pixel array 20 is improved.

In the present embodiment, time-division grayscale conversion is carried out for restraining motion blur which occurs on account of impulse-type driving. Any types of methods for converting grayscale can be used in the present invention, and the present invention can be used for any display apparatuses which perform display driving by time-diving input one frame into plural sub frames.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The present invention can be used for various types of display apparatuses such as a display monitor of a personal computer and a television receiver.

The invention claimed is:

1. A display apparatus comprising: scanning signal lines; data signal lines intersecting with the respective scanning signal lines; and pixels provided at respective intersections of the scanning signal lines and the data signal lines, the display apparatus time-dividing one frame of an input image signal into first to n-th sub frames (n is an integer not less than 2) so as to display an image on the pixels, the display apparatus further comprising:

signal generation means for generating display signals of the first to n-th sub frames from the input image signal;

data signal line drive means for generating grayscale display voltages corresponding to the display signals of the first to n-th sub frames in such a manner that, in each sub frame, grayscale display voltages output to pixels which are neighbored in a direction along the scanning signal lines and to pixels which are neighbored in a direction along the data signal lines are arranged to have inverse polarities and the polarity of a grayscale display voltage which is output to each of the pixels is reversed in each sub frame, in each group of sub frames, or in each frame, and outputting the generated grayscale display voltages to the respective data signal lines;

short-circuit means for switching the state of neighboring data signal lines between conduction and cutoff; and timing control means for generating a control signal which causes the pixels to perform image display using the display signals of the first to n-th sub frames, the timing control means causing an image display period of a first sub frame of an N-th frame (N is an integer not less than 2) to partly overlap at least an image display period of a second sub frame of the N-th frame and an image display period of an n-th sub frame of an (N−1)-th frame, so that a period during which the grayscale display voltages are written into all of the pixels in each sub frame is arranged to be equal to an image signal input period of one frame of the input image signal, and the timing control means generating the control signal in such a manner that, when the polarity of a grayscale display voltage which is output from the data signal line drive means to each of the data signal lines is reversed, a grayscale display voltage after polarity inversion is output to each of the data signal lines, after the short-circuit means is kept at the conduction state for a predetermined period of time.

2. The display apparatus as defined in claim 1, wherein, one frame of the input image signal is time-divided into first and second sub frames.

3. The display apparatus as defined in claim 1, wherein, the data signal line drive means generates the grayscale display voltages corresponding to the display signals of the first to n-th sub frames in such a way that the polarity of the grayscale display voltage output to each of the pixels is reversed in each sub frame, and the timing control means generates the control signal in such a way that, when image display periods of different sub frames are arranged to overlap one another, an odd-number-th scanning signal line and an even-number-th scanning signal line are alternately scanned.

4. The display apparatus as defined in claim 1, wherein, the data signal line drive means generates the grayscale display voltages corresponding to the display signals of the first to n-th sub frames in such a way that the polarity of the grayscale display voltage output to each of the pixels is reversed in each frame, and the timing control means generates the control signal in such a way that, when image display periods of different sub frames are arranged to overlap one another, plural odd-number-th scanning signal lines or plural even-number-th scanning signal lines are successively scanned.

5. The display apparatus as defined in claim 1, wherein, the timing control means generates the control signal in such a way that the short-circuit means is not changed to the cutoff state when the polarity of the grayscale display voltage output from the data signal line drive means to each of the data signal lines is not reversed.

6. The display apparatus as defined in claim 5, wherein, the timing control means generates the timing signal so that image display periods of respective sub frames have a substantially equal length.

7. The display apparatus as defined in claim 1, wherein, the timing control means generates the control signal in such a way that, when the polarity of the grayscale display voltage output from the data signal line drive means to each of the data signal line is not reversed, the short-circuit means is turned on for a period shorter than the predetermined period and then the grayscale display voltage is output to each of the data signal lines.

8. The display apparatus as defined in claim 7, wherein, the timing control means generates the timing signal so that image display periods of respective sub frames have a substantially equal length.

9. The display apparatus as defined in claim 1, wherein, the timing control means controls the short-circuit means by using a latch pulse which is a control signal for controlling a timing to output the grayscale display voltage from the data signal line drive means to each of the data signal line.

10. The display apparatus as defined in claim 9, wherein, when the polarity of the grayscale display voltage output from the data signal line drive means to each of the data signal lines is reversed, the timing control means arranges an active period of the latch pulse to be longer than an active period in a case where the polarity is not reversed, and the short-circuit means causes neighboring data signal lines to be electrically connected, during the active period of the latch pulse.

11. The display apparatus as defined in claim 10, wherein, the timing control means generates the timing signal so that image display periods of respective sub frames have a substantially equal length.

12. The display apparatus as defined in claim 9, wherein, the timing control means generates the timing signal so that image display periods of respective sub frames have a substantially equal length.

13. The display apparatus as defined in claim 1, wherein, the timing control means generates, for each of the scanning signal lines, the control signal in such a way that the grayscale display voltage corresponding to the display signal of each of the first to n-th sub frames is output from the data signal line drive means in a time division manner, and a selection signal is output from scanning signal line drive means in accordance with the output of the grayscale display voltage.

14. The display apparatus as defined in claim 1, wherein, the timing control means generates the control signal in such a way that a delay time from the input of the image signal of the N-th frame into each of the scanning signal lines to the writing of the grayscale display voltage in the first sub frame of the N-th frame is arranged to be shorter than the half of one frame of the input image signal.

15. The display apparatus as defined in claim 1, further comprising memory control means for controlling writing and readout into/from a frame memory which stores the input image signal, when a display signal of the n-th sub frame is generated for a pixel, the memory control means writes, into an area of the frame memory in which area the image signal for the pixel has been stored, an input image signal for another pixel.

16. The display apparatus as defined in claim 1, wherein, the signal generation means generates the display signal of the first sub frame from the input image signal without the intermediary of a frame memory in which the input image signal is stored, and generates the display signals of the second to n-th sub frames by reading out the image signal stored in the frame memory.

17. A display monitor, comprising:

the display apparatus as defined in claim 1; and signal input means for transmitting an externally-input image signal to the display apparatus.

18. A television receiver comprising the display apparatus as defined in claim 1.

19. A display method in which, in a display apparatus including:

scanning signal lines; data signal lines intersecting with the respective scanning signal lines; and pixels provided at respective intersections of the scanning signal lines and the data signal lines, one frame of an input image signal is time-divided into first to n-th sub frames (n is an integer not less than 2) so that an image is displayed on the pixels, an image display period of a first sub frame of an N-th frame (N is an integer not less than 2) being arranged to partly overlap at least an image display period of a second sub frame of the N-th frame and an image display period of an n-th sub frame of an (N−1)-th frame, so that a period during which the grayscale display voltages are written into all of the scanning signal lines of a display screen in each sub frame is arranged to be equal to an image signal input period of one frame of the input image signal, and when the polarity of a grayscale display voltage which is output from the data signal line drive means to each of the data signal lines is reversed, a grayscale display voltage after polarity inversion is output to each of the data signal lines, after neighboring data signal lines are short-circuited for a predetermined period of time.

20. The display method as defined in claim 19, wherein, one frame of the input image signal is time-divided into first and second sub frames.

21. The display method as defined in claim 19, wherein, the grayscale display voltages corresponding to the display signals of the first to n-th sub frames are generated in such a way that the polarity of the grayscale display voltage output to each of the pixels is reversed in each sub frame, and when image display periods of different sub frames are arranged to overlap one another, an odd-number-th scanning signal line and an even-number-th scanning signal line are alternately scanned.

22. The display method as defined in claim 19, wherein, the grayscale display voltages corresponding to the display signals of the first to n-th sub frames are generated in such a way that the polarity of the grayscale display voltage output to each of the pixels is reversed in each frame, and when image display periods of different sub frames are arranged to overlap one another, plural odd-number-th scanning signal lines or plural even-number-th scanning signal lines are successively scanned.

* * * * *